US010931052B2

(12) United States Patent
Amini et al.

(10) Patent No.: US 10,931,052 B2
(45) Date of Patent: Feb. 23, 2021

(54) CONNECTORS WITH CONTACTS BONDED TO TONGUE FOR IMPROVED STRUCTURAL INTEGRITY

(71) Applicant: Apple Inc., Cupertino, CA (US)

(72) Inventors: Mahmoud R. Amini, Sunnyvale, CA (US); Nikhil S. Pansare, Cupertino, CA (US); Michael A. Kinney, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/139,029

(22) Filed: Sep. 22, 2018

(65) Prior Publication Data

US 2019/0103697 A1 Apr. 4, 2019

Related U.S. Application Data

(60) Provisional application No. 62/565,369, filed on Sep. 29, 2017.

(51) Int. Cl.

| | |
|---|---|
| ***H01R 24/60*** | (2011.01) |
| ***H01R 13/405*** | (2006.01) |
| ***H01R 43/20*** | (2006.01) |
| ***H01R 13/504*** | (2006.01) |
| ***H01R 13/6585*** | (2011.01) |
| ***H01R 43/24*** | (2006.01) |
| *H01R 13/6597* | (2011.01) |
| *H01R 107/00* | (2006.01) |
| *H01R 12/72* | (2011.01) |
| *H01R 13/52* | (2006.01) |

(52) U.S. Cl.

CPC ..... *H01R 13/405* (2013.01); *H01R 13/504* (2013.01); *H01R 13/6585* (2013.01); *H01R 43/20* (2013.01); *H01R 43/24* (2013.01); *H01R 12/724* (2013.01); *H01R 13/521* (2013.01); *H01R 13/6597* (2013.01); *H01R 24/60* (2013.01); *H01R 2107/00* (2013.01)

(58) Field of Classification Search

CPC ..... H01R 24/60; H01R 13/521

See application file for complete search history.

(56) References Cited

U.S. PATENT DOCUMENTS

| | | | | |
|---|---|---|---|---|
| 8,198,563 | B2 * | 6/2012 | Tsai | H01R 24/62 218/140 |
| 9,142,926 | B2 * | 9/2015 | Tsai | H01R 27/00 |
| 9,882,323 | B2 | 1/2018 | Tziviskos et al. | |
| 9,991,640 | B2 | 6/2018 | Tziviskos et al. | |
| 2015/0162684 | A1 * | 6/2015 | Amini | H01R 24/60 439/660 |
| 2015/0200504 | A1 * | 7/2015 | Little | H01R 24/60 439/345 |
| 2016/0329667 | A1 * | 11/2016 | Tsai | H01R 13/5216 |
| 2017/0133795 | A1 * | 5/2017 | Guo | H01R 13/6581 |
| 2017/0155216 | A1 * | 6/2017 | Yao | H01R 13/5202 |
| 2017/0201048 | A1 * | 7/2017 | Kong | H01R 13/631 |
| 2017/0201053 | A1 * | 7/2017 | Guo | H01R 12/75 |
| 2017/0229823 | A1 * | 8/2017 | Tsai | H01R 24/60 |
| 2017/0324188 | A1 * | 11/2017 | Guo | H01R 13/5202 |

(Continued)

*Primary Examiner* — Tho D Ta

(74) *Attorney, Agent, or Firm* — Kilpatrick Townsend & Stockton, LLP

(57) ABSTRACT

Connector tongues that may provide a high signal quality or signal integrity to allow high speed data transfers, may be reliably manufactured, and may be durable and have good wear performance.

18 Claims, 30 Drawing Sheets

(56) References Cited

U.S. PATENT DOCUMENTS

| | | | | |
|---|---|---|---|---|
| 2017/0338576 | A1* | 11/2017 | Sato | H01R 12/721 |
| 2018/0076581 | A1* | 3/2018 | Tsai | H01R 13/6585 |
| 2018/0131111 | A1 | 5/2018 | Tziviskos | |

* cited by examiner

CONNECTORS WITH CONTACTS BONDED TO TONGUE FOR IMPROVED STRUCTURAL INTEGRITY

CROSS-REFERENCES TO RELATED APPLICATIONS

This application claims the benefit of U.S. provisional application No. 62/565,369, filed Sep. 29, 2017, which is incorporated by reference.

BACKGROUND

Power and data may be provided from one electronic device to another over cables that may include one or more wires, fiber optic cables, or other conductors. Connector inserts may be located at each end of these cables and may be inserted into connector receptacles in the communicating or power transferring electronic devices.

These connector receptacles and connector inserts may have various form factors. For example, a connector receptacle may include a tongue in a recess, where a corresponding connector insert fits in the recess and has an opening that accepts the connector receptacle tongue. In another example, a connector insert may include a tongue or may be formed as a tongue that fits in a connector receptacle. In either of these and other connector configurations a connector tongue is used.

Given the large amounts of data that may be transferred among connected devices, it may be desirable that these connector tongues be capable of supporting high data rates. That is, it may be desirable that these connector tongues provide a high signal quality or signal integrity to allow high speed data transfers between electronic devices.

Some of these electronic devices become tremendously popular. As a result, connectors having these connector tongues may be sold in very large quantities. Therefore, it may be desirable that these connector tongues be readily manufactured.

Users may connect and disconnect these connectors many times during a devices' lifetime. On occasion, a wrong connector insert may be inserted a connector receptacle. That is, a connector insert of a first type of connector system may be inserted into a connector receptacle of a second type of connector system. It these connector tongues break or show signs of wear prematurely, it may reduce user satisfaction and reflect poorly on the device and its manufacturer.

Thus, what is needed are connector tongues that may provide a high signal quality or signal integrity to allow high speed data transfers, may be reliably manufactured, and may be durable and have good wear performance.

SUMMARY

Accordingly, embodiments of the present invention may provide connector tongues that may provide a high signal quality or signal integrity to allow high speed data transfers, may be reliably manufactured, and may be durable and have good wear performance.

Users may plug connector inserts into connector receptacles several times a day. On occasion, a user may plug a connector insert into a connector receptacle at an angle. A user may also plug a connector insert for a first type of connector system into a connector receptacle of a second type of connector system. These inadvertent insertions may damage a portion of a connector receptacle. Such damage may reduce a functionality of an electronic device housing the connector receptacle. One type of damage that may occur may be the lifting of a pin from a housing or a tongue of the connector receptacle. This lifting may cause the pin to be damaged by being pushed further into the connector receptacle.

Accordingly, these and other embodiments of the present invention may provide connector receptacle tongues where contacts on the tongue are fixed to the tongue using adhesive or other material. The adhesive may be placed on a surface of the contacts between the contacts and the tongue. The adhesive may be cured, for example using heat or UV. When a connector insert for a first type of connector system is inserted into a connector receptacle for a second type of connector system, the contacts may remain fixed to the tongue and not become separated. This may prevent the contacts from being damaged. In other embodiments of the present invention, contacts in a housing or other connector receptacle portion may be fixed with an adhesive to the housing or other connector receptacle portion.

These and other embodiments of the present invention may provide connector receptacle tongues where leading edges of contacts on the tongue are covered with an overmold. In these and other embodiments of the present invention, the leading edges of the tongue contacts may be angled towards the tongue. Some or all of the tongue may be covered with an overmold. The overmold may be located over the leading edges of the tongue contacts. This may prevent the contacts from being separated from the tongue and damaged when a connector insert for a first type of connector system is inserted into a connector receptacle for a second type of connector system.

These and other embodiments of the present invention may provide connector receptacle tongues where leading edges of contacts on the tongue are protected behind a cross-beam or other structure. The cross-beam may be part of a frame. The frame may be metallic or other durable material. The cross-beam may shield leading edges of the contacts to prevent them from being separated from the tongue when a connector insert for a first type of connector system is inserted into a connector receptacle for a second type of connector system.

Embodiments of the present invention may provide connectors that may be connected and disconnected several times without incident. An illustrative embodiment of the present invention may accomplish this by providing insulative moldings around portions of conductive structures in the connectors. The insulative moldings may help to prevent or reduce the occurrence of unintended current paths that may be formed of accumulated conductive material on or in the connector.

These connector receptacles may undergo further assembly processes after these adhesive layers or overmolds are formed. These process may cause contacts on a tongue to become separated from the tongue, making eventual damage more likely.

Accordingly, these and other embodiments of the present invention may provide a reflow cap. A tongue of a connector receptacle may fit in a central passage of the reflow cap. The reflow cap may include a plurality of ribs to secure the tongue to the reflow cap. A recess in the central passage may accept a leading edge of the tongue. The recess in the central passage may apply pressure on the tongue to hold the contacts against the tongue during assembly. This may prevent the contacts from lifting away from the tongue. The reflow cap may include a tab near a front of the reflow cap, wherein the tab is used in automated removal of the reflow cap after assembly.

These and other embodiments of the present invention may provide connectors that may be connected and disconnected several times without incident. An illustrative embodiment of the present invention may accomplish this by providing insulative moldings around portions of conductive structures in the connectors. The insulative moldings may help to prevent or reduce the occurrence of unintended current paths that may be formed of accumulated conductive material on or in the connector.

These and other embodiments of the present invention may provide connectors that are durable by providing frames for connector tongues. These frames may provide reinforcement for the tongue and improve the tongues resilience to withstand lateral and other types of forces. Sides of the frame may be located along sides of the tongue. Central ground planes or one or more cross-beams may join the sides of the frame together for additional support. The frame may be metallic, ceramic, or other material. Instead of a frame, side plating may be used to provide reinforcement and improved durability. The side plating may be located along sides of the tongue, as well as along a top and bottom of the tongue near the sides of the tongue.

The metal used for the frame or side plating may come into physical contact with metallic structures on corresponding connectors when the connectors are mated. The physical contact of the metallic surfaces may cause abrasion, chipping, or other damage. This damage may generate conductive particles, such as metallic shavings. These conductive particles may be supplemented by other conductive debris that may find its way into or onto the connectors. Repeated insertions of a connector insert into a connector receptacle may push this accumulated material into one or more specific areas, referred to here as accumulation zones. When these accumulation zones are at least partly bounded by or include conductive structures, the accumulated material may form unintended current paths between the conductive structures.

Accordingly, embodiments of the present invention may provide insulative moldings between these conductive structures. The insulative moldings may then prevent or reduce the occurrence of these unintended current paths. Embodiments of the present invention may provide connectors that are readily manufactured by providing insulative moldings that are formed by injection molding or other mechanical step or other process.

An illustrative embodiment of the present invention may provide an improved connector tongue for a Universal Serial Bus (USB) Type-C connector receptacle. The connector tongue may include a metallic frame or edge plating for improved durability. The connector tongue may include contacts extending from near a front of the tongue to a rear of the connector receptacle. Top and bottom ground pads may extend laterally over the contacts. A plastic or other nonconductive tongue molding may support the contacts. The tongue molding may have upper and lower portions to insulate the ground pads from the contacts.

This structure may create an accumulation zone along a front side of the upper and lower portions of the tongue molding, between a front of the connector receptacle and the ground pads. Accumulated particles in this accumulation zone may form undesirable conductive paths between contacts, or between one or more contacts and a ground pad.

Accordingly embodiments of the present invention may provide insulative moldings around portions of the contacts near this accumulation zone. These insulative moldings may prevent or reduce the creation of undesirable conductive paths. The insulative moldings may be formed by injection molding or other mechanical step or other type of process. The insulative moldings may be formed of plastic or other nonconductive material. The color of the insulative moldings may be chosen to enhance the appearance of the connector. For example, the insulative moldings may have various colors or combinations of colors. The insulative moldings may be colored to match or mismatch a tongue molding or other connector portion. The insulative moldings may be transparent, translucent, partially opaque, or opaque. In one example, the insulative moldings may be white to match a tongue molding.

In other embodiments of the present invention, insulative layers may be formed around portions of contacts or other connector structures by applying ink or other nonconductive material using printing, such as ink-jet type printing, 3-D printing, aerosol jet printing, pad printing, or other types of printing. In these and other embodiments, the ink may be nonconductive. This ink may be comparatively thick for improved wear performance. The ink may be a liquid, paste, or other substance, though pastes may more readily provide a thicker coverage. The thickness of the ink may be increased by printing the insulative moldings on the contacts multiple times. The ink may be formed of a colorant and a binder. The binder may allow the colorant to adhere to one or more surfaces of the contacts or other connector structures. The colorant may be a dye or pigment. Pigments may include organic or inorganic particles. The pigments may provide color and may also provide improved wear performance. Other substances such as resins, lubricants, surfactants, and solvents may also be included in the ink to improve adhesion, wear performance, and other characteristics.

In various embodiments of the present invention, the ink may have various colors or combinations of colors. The ink may be colored to match or mismatch a tongue molding or other connector portion. The ink may be transparent, translucent, partially opaque, or opaque. In one example, the ink may be white to match a tongue molding.

In various embodiments of the present invention, the ink may have various thicknesses. In one embodiment of the present invention, each contact may be 250 microns wide and located in a groove in the tongue molding that is 300 microns wide. The contacts may each have a side adjacent to the tongue molding and the other sides may be coated with a 25 micron layer of ink. The addition of the ink insulative molding to the contacts may help to center the contacts in their grooves for improved alignment and improved reliability.

Connectors may be formed in various ways in various embodiments of the present invention. An illustrative embodiment of the present invention may provide a method of forming a USB Type-C connector receptacle. A frame for the connector receptacle may be formed. The frame may have sides and a center ground plane or one or more cross-beams joining the sides. The frame may attach to a frame support. Top and bottom ground pads may extend from a front of the frame support. An insert molded tongue molding may be formed between the sides of the frame. The insert molded tongue molding may cover the center ground plane or the one or more of the cross-beams. Covering a cross-beam near a front of the tongue with the tongue molding may reduce wear on a corresponding connector. The tongue molding may include upper and lower portions. Passages in the tongue molding between the upper and lower portions and the tongue portion may be included to allow the insertion of contacts into groves in the tongue molding.

Top and bottom sets of contacts may be formed. The contacts may have contacting portions to mate with contacts in a corresponding connector insert. Top and bottom contact housings may be formed around rear portions of top and bottom sets of contacts. Ground contacts may be folded back over the contact housings, or they may be left intact where they may fit in grooves in frame sides of a frame. Insulative moldings may be formed around middle portions of the contacts in the top and bottom sets of contacts. Alternatively, an ink insulation layer may be applied to sides and top surface of each contact in the top set of contacts, and to the sides and bottom surface of each contact in the bottom set of contacts. The contact housing of the top set of contacts may be joined to the contact housing of the bottom set of contacts. For example, tabs on the housing for the top set of contacts may fit in notches in the housing for the bottom set of contacts. The contacts may then be inserted though the passages and into the grooves in the tongue molding. Tabs formed in the contact housings may fit into openings in the frame support to secure the contacts to the frame. The folded back ground contacts may electrically and physical contact the frame support. Where ink is used, the contact surfaces adjacent to the tongue molding (the bottom side of the top set of contacts and the top side of the bottom set of contacts) may remain ink free to help the contacts stay flush against the tongue molding.

While embodiments of the present invention may be useful as USB Type-C connector receptacles, these and other embodiments of the present invention may be used as connector receptacles in other types of connector systems.

In various embodiments of the present invention, frames, shields, and other conductive portions of a connector receptacle may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the reflow caps and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards used may be formed of FR-4 or other material.

Embodiments of the present invention may provide connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These connector receptacles may provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector receptacles that may be used to provide a reduced set of functions for one or more of these standards. In various embodiments of the present invention, these interconnect paths provided by these connector receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
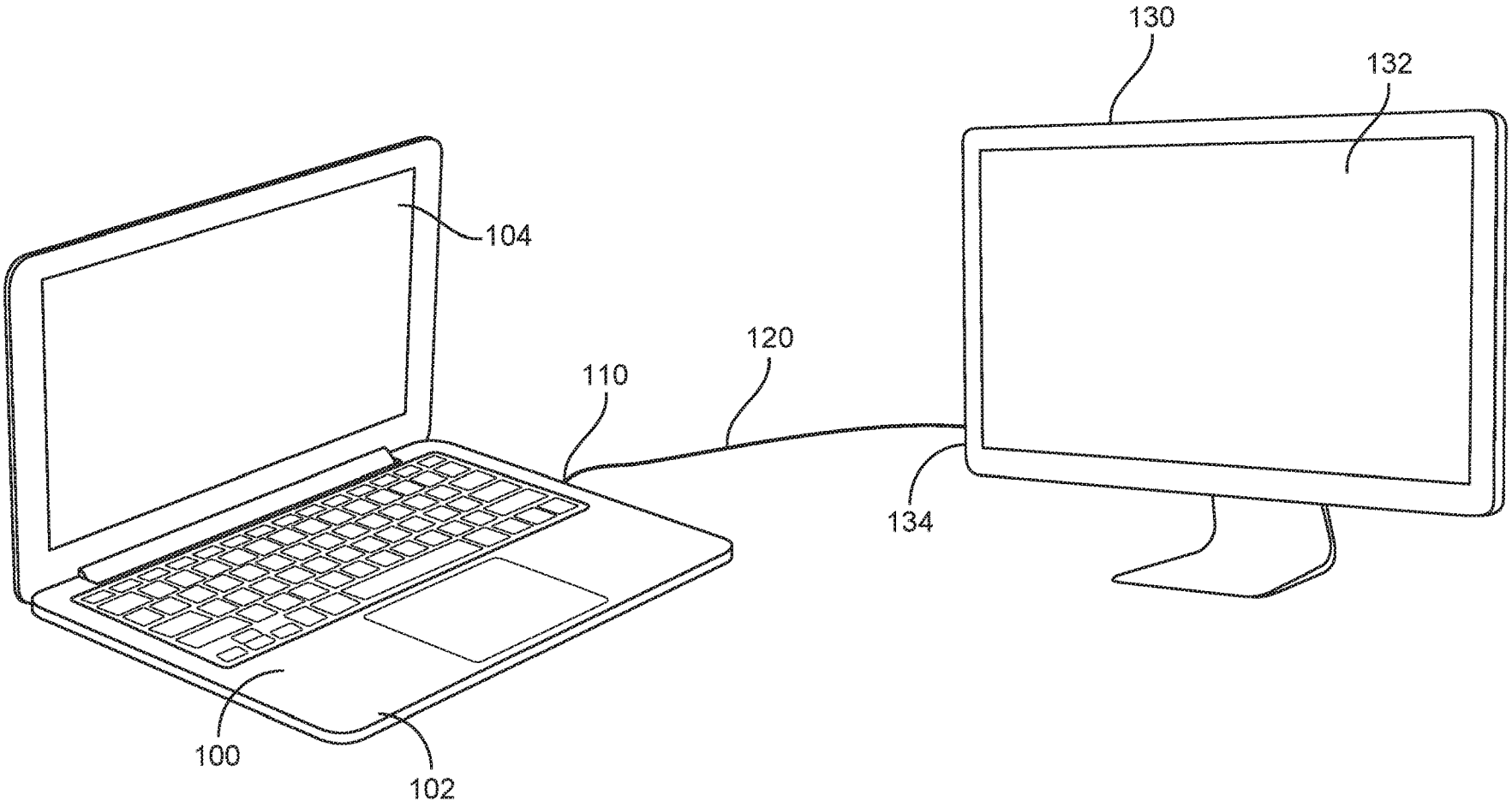
FIG. 1 illustrates an electronic system that may be improved by the incorporation of embodiments of the present invention.

FIG. 1 illustrates an electronic system that may be improved by the incorporation of an embodiment of the present invention. This figure, as with the other included figures, is shown for illustrative purposes and does not limit either the possible embodiments of the present invention or the claims.

This example illustrates monitor 130 that may be in communication with computer 100. Computer 100 may be substantially housed in device enclosure 102. Computer 100 may provide video or other data over cable 120 to monitor 130. Video data may be displayed on the video screen 132 of monitor 130. Computer 100 may similarly include a screen 104. In other embodiments the present invention, other types of devices may be included, and other types of data may be shared or transferred among the devices. For example, monitor 130 may be a monitor, an all-in-one computer, tablet computer, or other device. In these and other embodiments of the present invention, power may be shared between computer 100 and monitor 130 over cable 120.

Cable 120 may be one or a number of various types of cables. For example, it may be a Universal Serial Bus (USB) cable such as a USB Type-C cable, Thunderbolt, DisplayPort, Lightning, or other type of cable. Cable 120 may include compatible connector inserts (not shown) that plug into connector receptacle 110 on the computer 100 and connector receptacle 134 on monitor 130.

Figure 2:
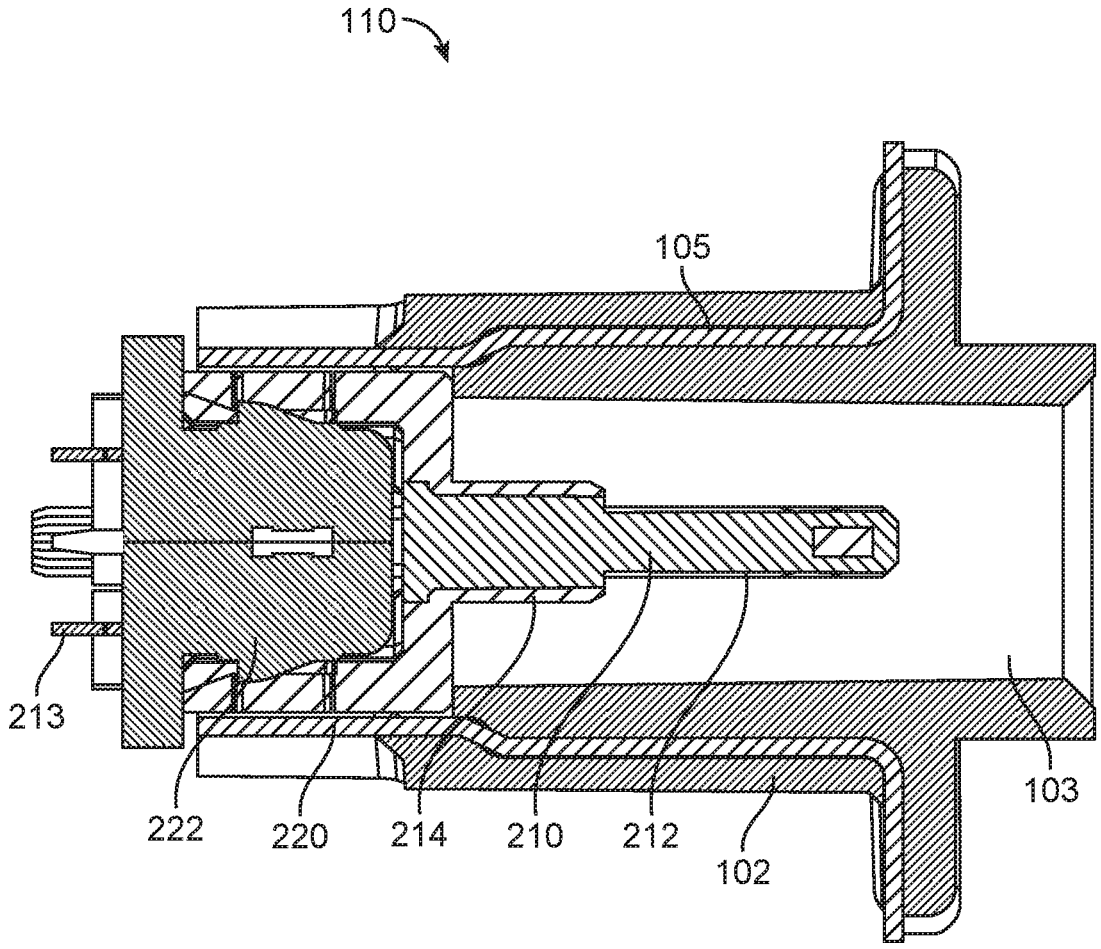
FIG. 2 illustrates a cutaway side view of a connector receptacle according to an embodiment of the present invention.

FIG. 2 illustrates a cutaway side view of a connector receptacle according to an embodiment of the present invention. This connector receptacle may be used as connector receptacle 110, or as other connector receptacles in other embodiments of the present invention. In this example, connector receptacle 110 may be located in device enclosure 102. Connector receptacle 110 may include tongue 210 supporting a number of contacts 212 on top and bottom sides. Ground contacts 214 may be located on top and bottom sides of tongue 210. Housing 222 may support contacts 212. Contacts 212 may terminate in contacting portions 213. Contacting portions 213 may be soldered to contacts or openings of a printed circuit board or other appropriate substrate. Connector receptacle 110 may be shielded by shield 105.

In these and other embodiments of the present invention, connector receptacle 110 may be used as a USB Type-C connector receptacle. On occasion, a user may attempt to plug an incompatible connector insert into connector receptacle 110. For example, a user may inadvertently attempt to plug a lightning connector insert (not shown) into USB Type-C connector receptacle 110. The lightning connector insert may strike tongue 210. In doing so, tongue 210 may be pushed either upwards or downwards in opening 103 of device enclosure 102. This deflection may separate contacts 212 from tongue 210. Contact 212 may then be bent and pushed deeper into opening 103 in device enclosure 102. Accordingly, embodiments of the present invention may provide various methods and structures for preventing this separation between contacts 212 and tongue 210. Examples are shown in the following figures.

Figure 3:
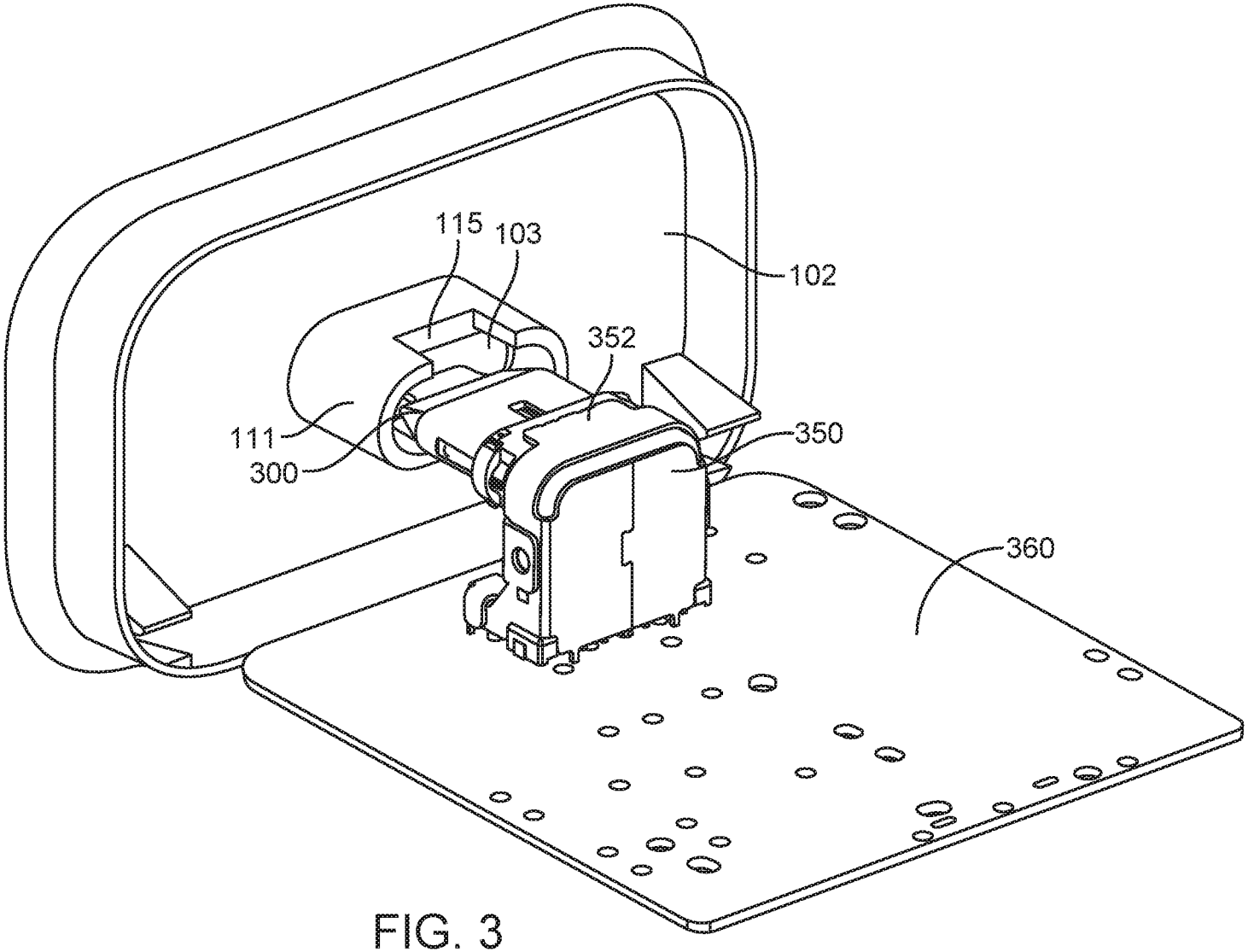
FIG. 3 illustrates a connector receptacle and device enclosure being assembled according to an embodiment of the present invention.

FIG. 3 illustrates a connector receptacle and device enclosure being assembled according to an embodiment of the present invention. This figure includes connector receptacle 350 having a tongue (not shown) held in place by reflow cap 300. Connector receptacle 350 may be attached to printed circuit board 360 or other appropriate substrate. Portion of device enclosure 102 may be attached to printed circuit board 360 and connector receptacle 350. Device enclosure 102 may include extension 111, which may form opening 103. Extension 111 may have a notch 115 to accept a ground portion 352 of connector receptacle 350.

Figure 4:
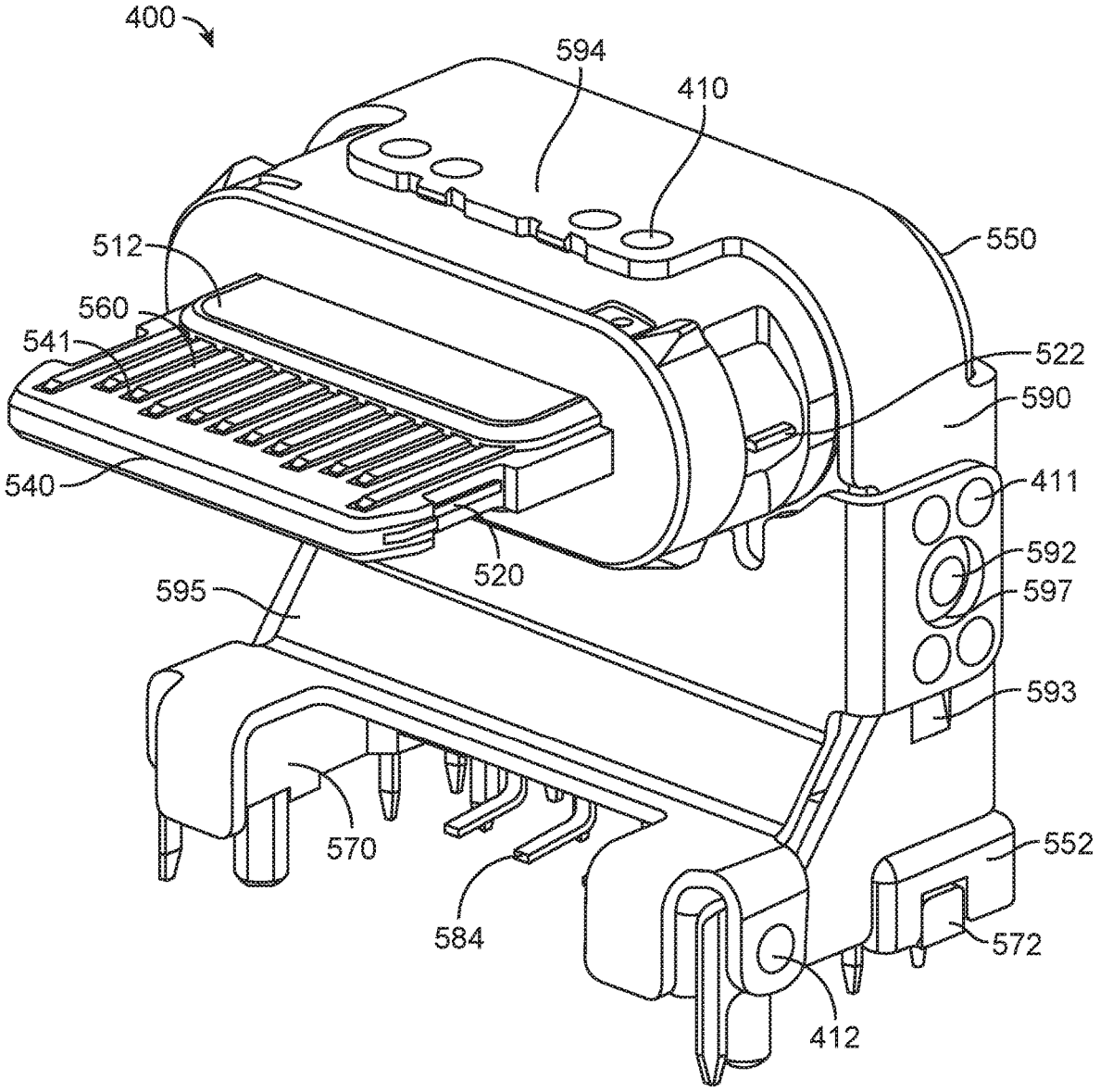
FIG. 4 illustrates a connector receptacle according to an embodiment of the present invention.

FIG. 4 illustrates a connector receptacle according to an embodiment of the present invention. Connector receptacle 400 may be used as connector receptacle 110 or 350, or as another connector in these and other embodiments of the present invention. Connector receptacle 400 may include a tongue 540 supporting a number of contacts 560 on a top side and a number of contacts 580 on a bottom side (shown in FIG. 5.) Contacts 560 may partially housed in first housing 550, while contacts 580 may be partially housed in second housing 570. First housing 550 may include inverted U-shaped portion 552 for accepting tab 572 of second housing 570.

Top ground contact 512 and bottom ground contact 532 (shown in FIG. 5) may be located on top and bottom sides of tongue 540. Tongue 540 may include a central ground plane 520, which may form side contacts on tongue 540 as well as side ground contacts or tabs 522. Contacts 560 may include contacting portions on a surface of tongue 540, where the contacting portions form electrical connections with contacts in a corresponding connector insert when the connector insert is mated with connector receptacle 400. Contacts 580 on the underside of tongue 540 may also include tail portions 584, which may be soldered to contacts or through holes on a printed circuit board or other appropriate substrate.

Connector receptacle 400 may be shielded by a top shield 590 and a bottom shield 595. Top shield 590 and bottom shield 595 may be fixed to each by laser welding or other technique at locations 410, 411, and 412. Raised dimple 592 on top shield 590 may fit in opening 597 on bottom shield 595. Tab 593 may be secured against ledge 576 (shown in FIG. 5.)

Again, an incompatible connector insert that is plugged into a connector receptacle 400 may strike tongue 540 deflecting it either and up or down direction. This may cause leading edges 541 of contacts 560 on a top side of tongue 540, or leading edges (not shown) of contacts 580 on a bottom side of tongue 540, to separate from tongue 540. Once separated, these contacts may be pushed backwards and bent or otherwise damaged.

Accordingly, embodiments of the present invention may provide an adhesive layer or other material to fix contacts 560 and 580 to tongue 540. These adhesive layers are shown in the following figure.

Figure 5:
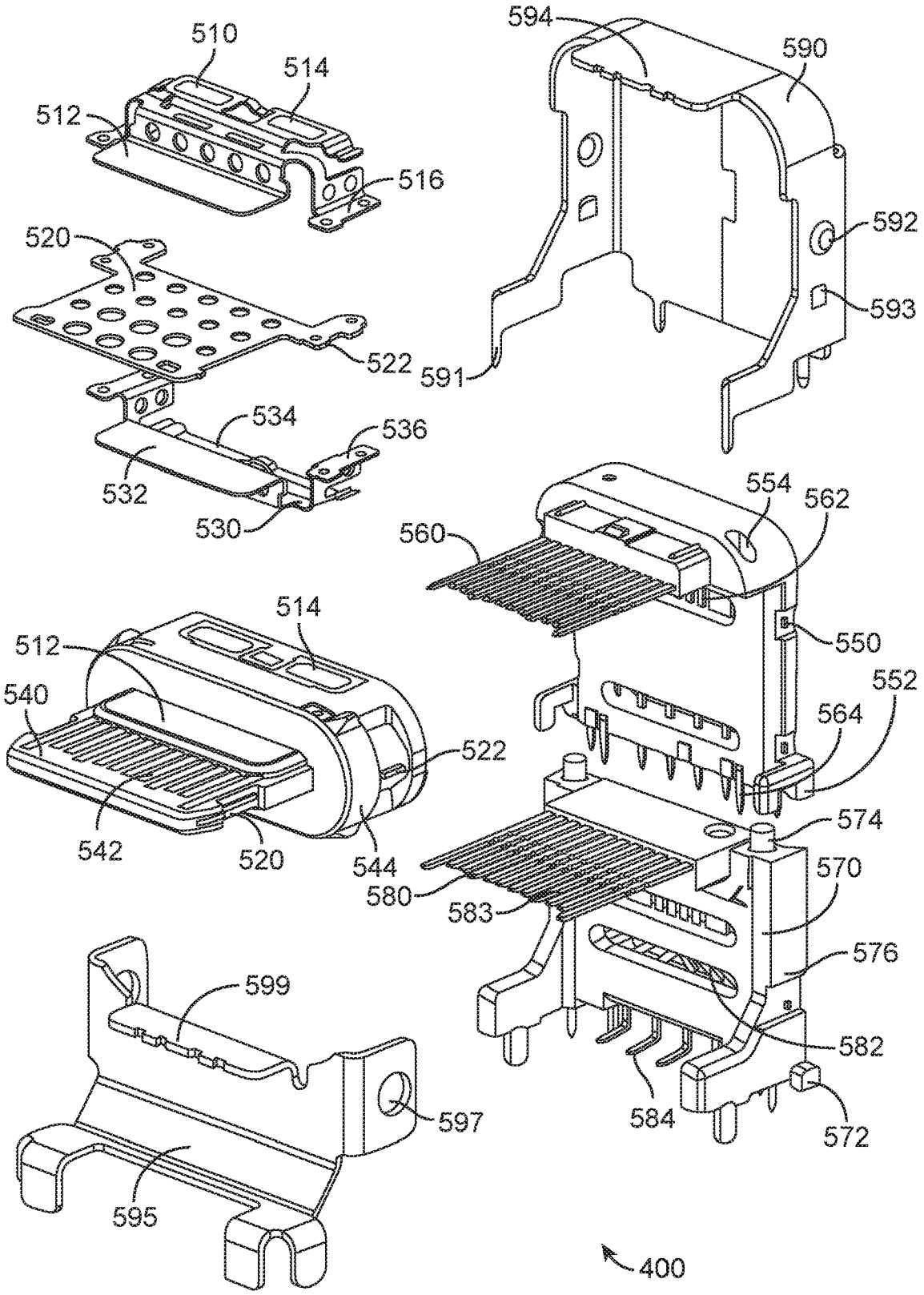
FIG. 5 illustrates a method of manufacturing a connector receptacle according to embodiments of the present invention.

FIG. 5 illustrates a method of manufacturing a connector receptacle according to embodiments of the present invention. Top ground structure 510 may include top ground contact 512, shield contact 514, as well as side tabs 516. Central ground plane 520 may include tabs 522. Bottom ground structure 530 may include ground contact 532, shield contact 534, as well as tabs 536. Tabs 516, 522, and 536 may be aligned and soldered or laser welded to each other. Tongue 540 may be molded around the attached ground structures 510 and 530, and central ground plane 520. Tongue 540 may include slots 542 for accepting contacts 560 and 580. Tongue 540 may also include top ground contact 512, bottom ground contact 532, shield contact 514, and shield contact 534.

Contacts 560 may include contacting portions, middle transition portions 562, and tail portions 564. Middle transition portions 562 may include angled portions to increase a spacing between contacts 560 such that tail portions 564 may be more readily attached to a printed circuit board or other appropriate substrate (not shown.)

Contacts 580 may include contacting portions, middle transition portions 582, and tail portions 584. Middle transition portions 582 may include angled portions to increase a spacing between contacts 580 such that tail portions 584 may be more readily attached to a printed circuit board or other appropriate substrate.

Contacts 560 may be partially housed in first housing 550. Specifically, middle transition portions 562 may be housed in first housing 550. First housing 550 may include passage 554 and inverted U-shaped portion 552. Contacts 580 may be partially housed in second housing 570. Specifically, middle transition portions 582 may be housed in second housing 570. Second housing 570 may include ledge 576, tab 572, and tab 574. Tab 574 may fit in passage 554 in first housing 550. Inverted U-shaped portion 552 may fit over tab 572 to secure first housing 550 to second housing 570. Contacts 560 and 580 may be inserted into tongue 540 such that contacts 560 and 580 are located in slots 542 on top and bottom sides of tongue 540.

Connector receptacle 400 may be shielded by top shield 590 and bottom shield 595. Raised dimple 592 on top shield 590 may fit in opening 597 in bottom shield 595. Extension 594 of top shield 590 may be soldered or laser welded to shield contact 514. Tab 593 may fit against ledge 576 on second housing 570. Extension 599 may be soldered or laser welded to shield contact 534.

Adhesive layer 583 may be applied to a surface of contacts 560 and 580. Specifically, adhesive layers 583 may be applied to a bottom side of contacting portions of contacts 560 and a top side of contacting portions of contacts 580. In these and other embodiments of the present invention, the adhesive may be located in slots 542 in tongue 540. That is, the adhesive layers may be located between contacts 560 and tongue 540, and between contacts 580 and tongue 540. This adhesive may prevent a separation of contacts 560 and contacts 580 from tongue 540 during an insertion of an incompatible connector insert.

In these and other embodiments of the present invention, separation of the contacts from a tongue may be prevented by forming an overmold over leading edges of contacts on a top and bottom side of a connector receptacle tongue. Examples are shown in the following figures.

Figure 6:
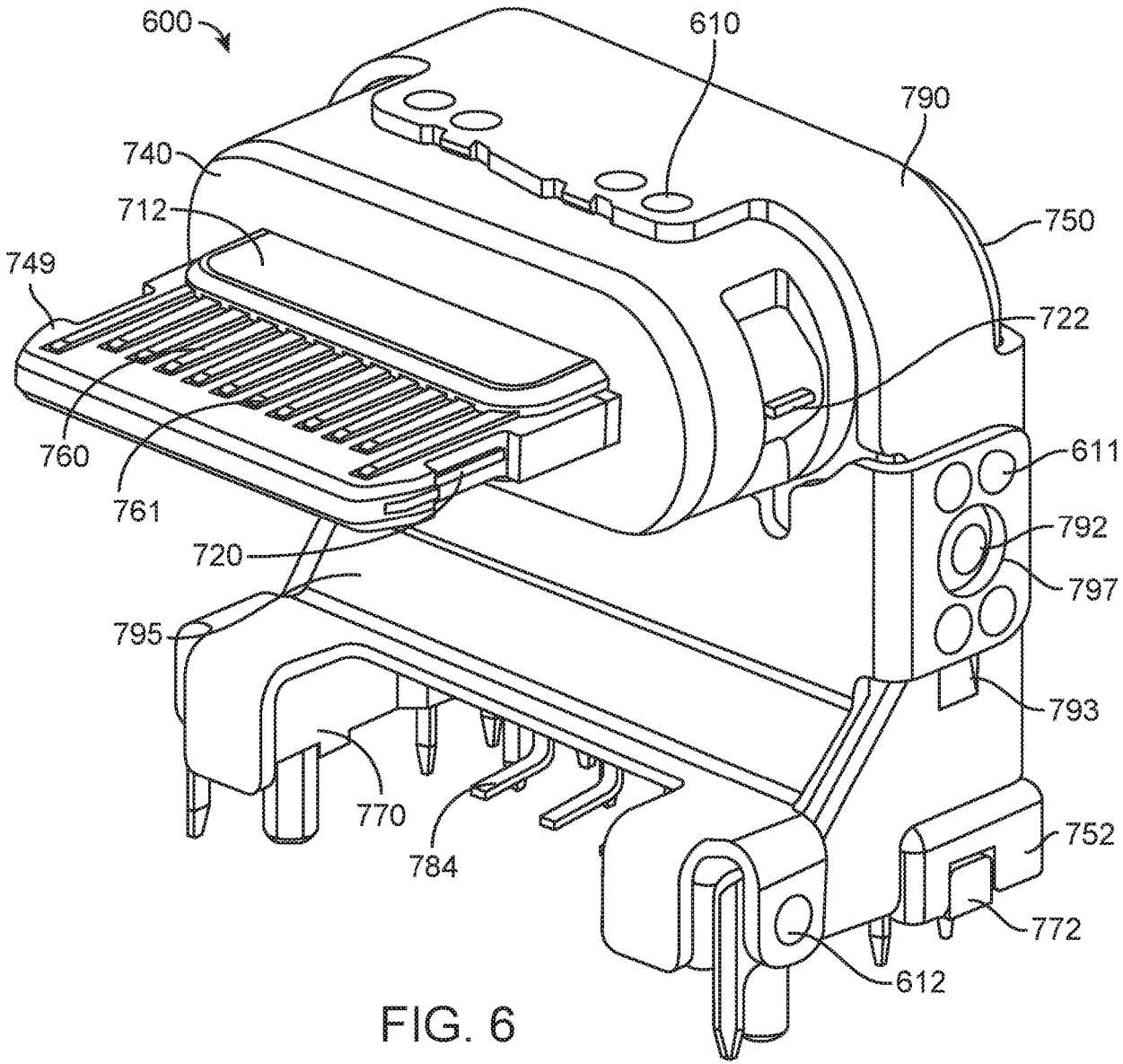
FIG. 6 illustrates a connector receptacle according to an embodiment of the present invention.

FIG. 6 illustrates a connector receptacle according to an embodiment of the present invention. Connector receptacle 600 may be used as connector receptacle 110 or 350, or as another connector in these and other embodiments of the present invention. Connector receptacle 600 may include a tongue 740 supporting a number of contacts 760 on a top side and a number of contacts 780 on a bottom side (shown in FIG. 7.) Contacts 760 may partially housed in first housing 750, while contacts 780 may be partially housed in second housing 770. First housing 750 may include inverted U-shaped portion 752 for accepting tab 772 of second housing 770.

Ground contacts 712 may be located on top and bottom sides of tongue 740. Tongue 740 may include a central ground plane 720, which may form side contacts on tongue 740 as well as side ground contacts or tab 722. Contacts 760 may include contacting portions on a surface of tongue 740, where the contacting portions form electrical connections with contacts in a corresponding connector insert when the connector insert is mated with connector receptacle 600. Contacts 780 on the underside of tongue 740 may also include tail portions 784, which may be soldered to contacts or through holes on a printed circuit board or other appropriate substrate.

Connector receptacle 600 may be shielded by a top shield 790 and a bottom shield 795. Top shield 790 and bottom shield 795 may be fixed to each by laser welding or other technique at locations 610, 611, and 612. Raised dimple 792 on top shield 790 may fit in opening 797 on bottom shield 795. Tab 793 may be secured against ledge 776 (shown in FIG. 7.)

Again, an incompatible connector insert that is plugged into a connector receptacle 600 may strike tongue 740 deflecting it either and up or down direction. This may cause leading edges 741 of contacts 760 on a top side of tongue 740, or leading edges (not shown) of contacts 780 on a bottom side of tongue 740, to separate from tongue 740. Once separated, these contacts may be pushed backwards and bent or otherwise damaged.

Figure 7:
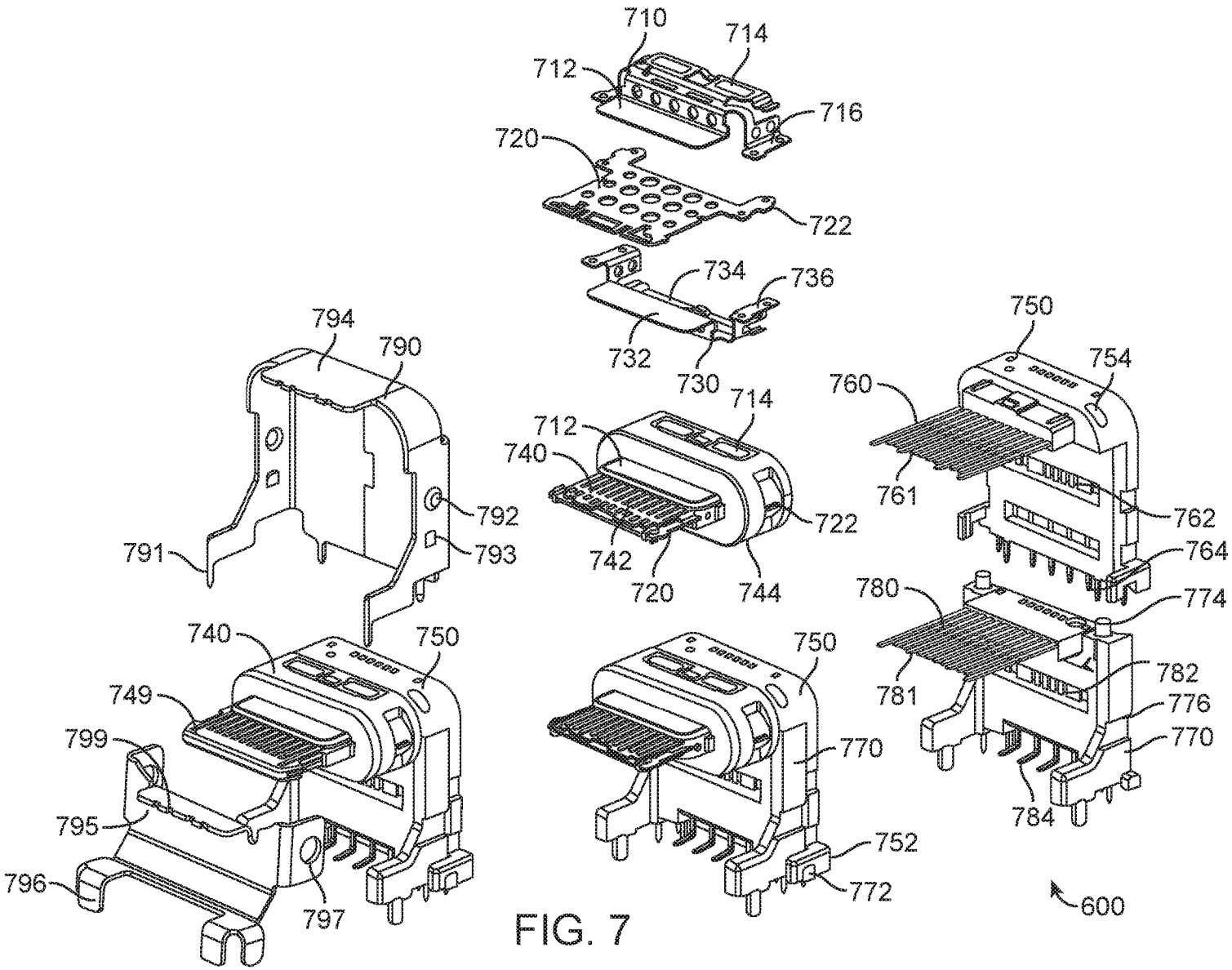
FIG. 7 illustrates a method of manufacturing a connector receptacle according to embodiments of the present invention.

Accordingly, embodiments of the present invention may provide an overmold or other layer that may be formed at least over leading edges 761 of contacts 760 and leading edges 781 of contacts 780 (shown in FIG. 7.) This overmold may fix contacts 760 and 780 to tongue 740. This overmold layer is shown in the following figure.

FIG. 7 illustrates a method of manufacturing a connector receptacle according to embodiments of the present invention. Top ground structure 710 may include ground contact 712, shield contact 714, as well as side tabs 716. Central ground plane 720 may include tabs 722. Bottom ground structure 730 may include ground contact 732, shield contact 734, as well as tabs 736. Tabs 716, 722, and 736 may be aligned and soldered or laser welded to each other. Tongue 740 may be molded around the attached ground structures 710 and 730, and central ground plane 720. Tongue 740 may include slots 742 for accepting contacts 760 and 780. Tongue 740 may also include top ground contact 712, bottom ground contact 732, shield contact 714, and shield contact 734.

Contacts 760 may include contacting portions, middle transition portions 762, and tail portions 764. Middle transition portions 762 may include angled portions to increase a spacing between contacts 760 such that tail portions 764 may be more readily attached to a printed circuit board or other appropriate substrate (not shown.)

Contacts 780 may include contacting portions, middle transition portions 782, and tail portions 784. Middle transition portions 782 may include angled portions to increase a spacing between contacts 780 such that tail portions 784 may be more readily attached to a printed circuit board or other appropriate substrate.

Contacts 760 may be partially housed in first housing 750. Specifically, middle transition portions 762 may be housed in first housing 750. First housing 750 may include passage 754 and inverted U-shaped portion 752. Contacts 780 may be partially housed in second housing 770. Specifically, middle transition portions 782 may be housed in second housing 770. Second housing 770 may include ledge 776, tab 772, and tab 774. Tab 774 may fit in passage 754 in first housing 750. Inverted U-shaped portion 752 may fit over tab 772 to secure first housing 750 to second housing 770. Contacts 760 and 780 may be inserted into tongue 740 such that contacts 760 and 780 are located in slots 742 on top and bottom sides of tongue 740.

Connector receptacle 600 may be shielded by top shield 790 and bottom shield 795. Raised dimple 792 on top shield 790 may fit in opening 797 in bottom shield 795. Extension 794 of top shield 790 may be soldered or laser welded to shield contact 714. Tab 793 may fit against ledge 776 on second housing 770. Extension 799 may be soldered or laser welded to shield contact 734.

Leading edges 761 of contacts 760 and leading edges 781 of contacts 780 may be angled such that they are closer to tongue 740 near a leading edge of tongue 740. Leading edges 761 of contacts 760 and leading edges 781 of contacts 780 may be may covered by overmold 749. Overmold 749 may be a second injection molding in a two-shot molding process. Overmold 749 may prevent separation of contacts 760 and contacts 780 from tongue 740 when an incompatible connector insert is plugged into connector receptacle 600.

The moldings used to form first housing 750, second housing 770, tongue 740, and overmold 749, may be varied in these and other embodiments of the present invention. Examples are shown in the following figures.

Figure 8:
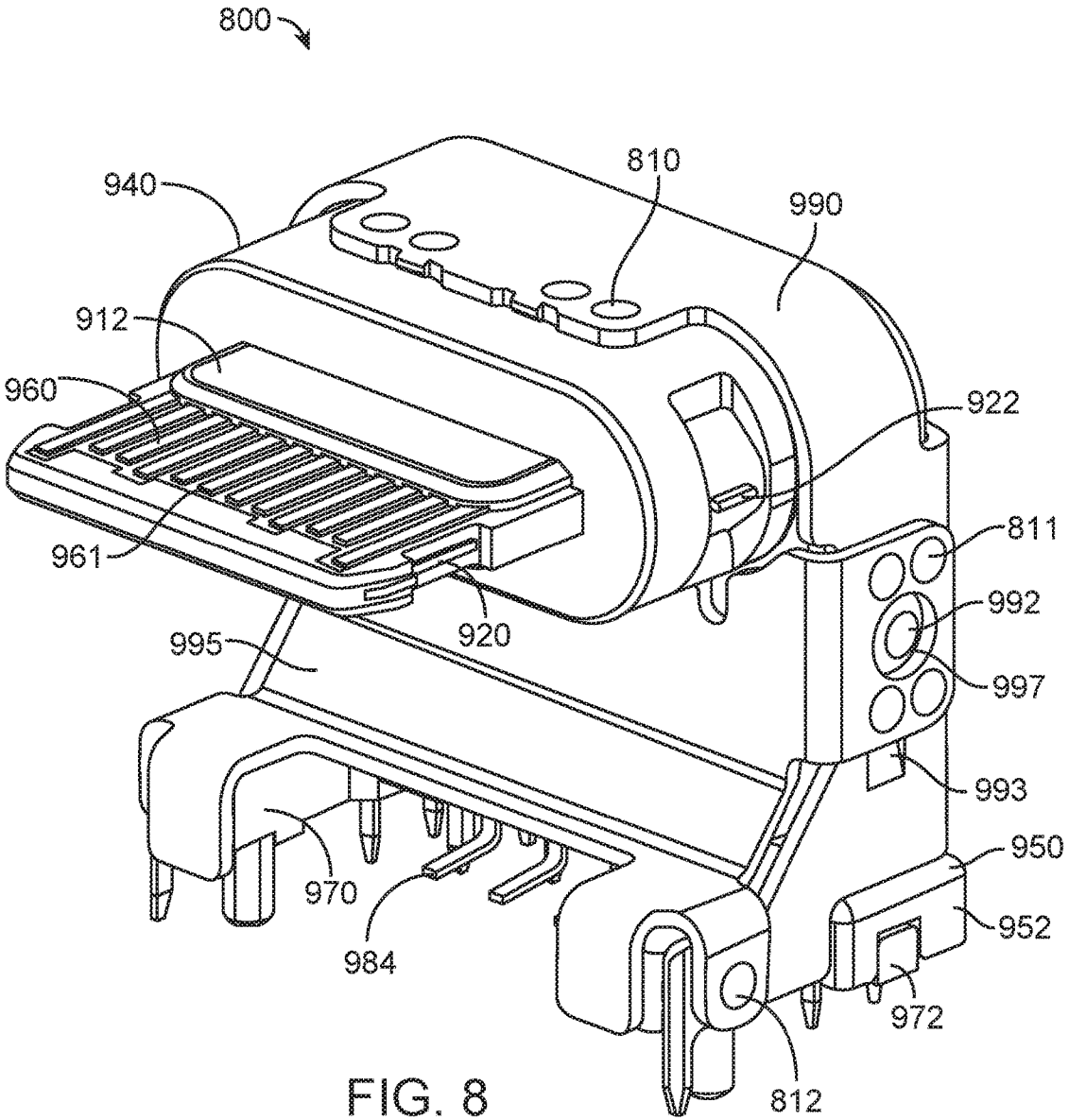
FIG. 8 illustrates a connector receptacle according to an embodiment of the present invention.

FIG. 8 illustrates a connector receptacle according to an embodiment of the present invention. Connector receptacle 800 may be used as connector receptacle 110 or 350, or as another connector in these and other embodiments of the present invention. Connector receptacle 800 may include a tongue 940 supporting a number of contacts 960 on a top side and a number of contacts 980 on a bottom side (shown in FIG. 9.) Contacts 960 may partially housed in first housing 950, while contacts 980 may be partially housed in third housing 970. First housing 950 may include inverted U-shaped portion 952 for accepting tab 972 of third housing 970.

Ground contacts 912 may be located on top and bottom sides of tongue 940. Tongue 940 may include a central ground plane 920, which may form side contacts on tongue 940 as well as side ground contacts or tabs 922. Contacts 960 may include contacting portions on a surface of tongue 940, where the contacting portions form electrical connections with contacts in a corresponding connector insert when the connector insert is mated with connector receptacle 800. Contacts 980 on the underside of tongue 940 may also include tail portions 984, which may be soldered to contacts or through holes on a printed circuit board or other appropriate substrate.

Connector receptacle 800 may be shielded by a top shield 990 and a bottom shield 995. Top shield 990 and bottom shield 995 may be fixed to each by laser welding or other technique at locations 810, 811, and 812. Raised dimple 992 on top shield 990 may fit in opening 997 on bottom shield 995. Tab 993 may be secured against ledge 976 (shown in FIG. 9.)

Again, an incompatible connector insert that is plugged into a connector receptacle 800 may strike tongue 940 deflecting it either and up or down direction. This may cause leading edges 941 of contacts 960 on a top side of tongue 940, or leading edges (not shown) of contacts 980 on a bottom side of tongue 940, to separate from tongue 940. Once separated, these contacts may be pushed backwards and bent or otherwise damaged.

Figure 9:
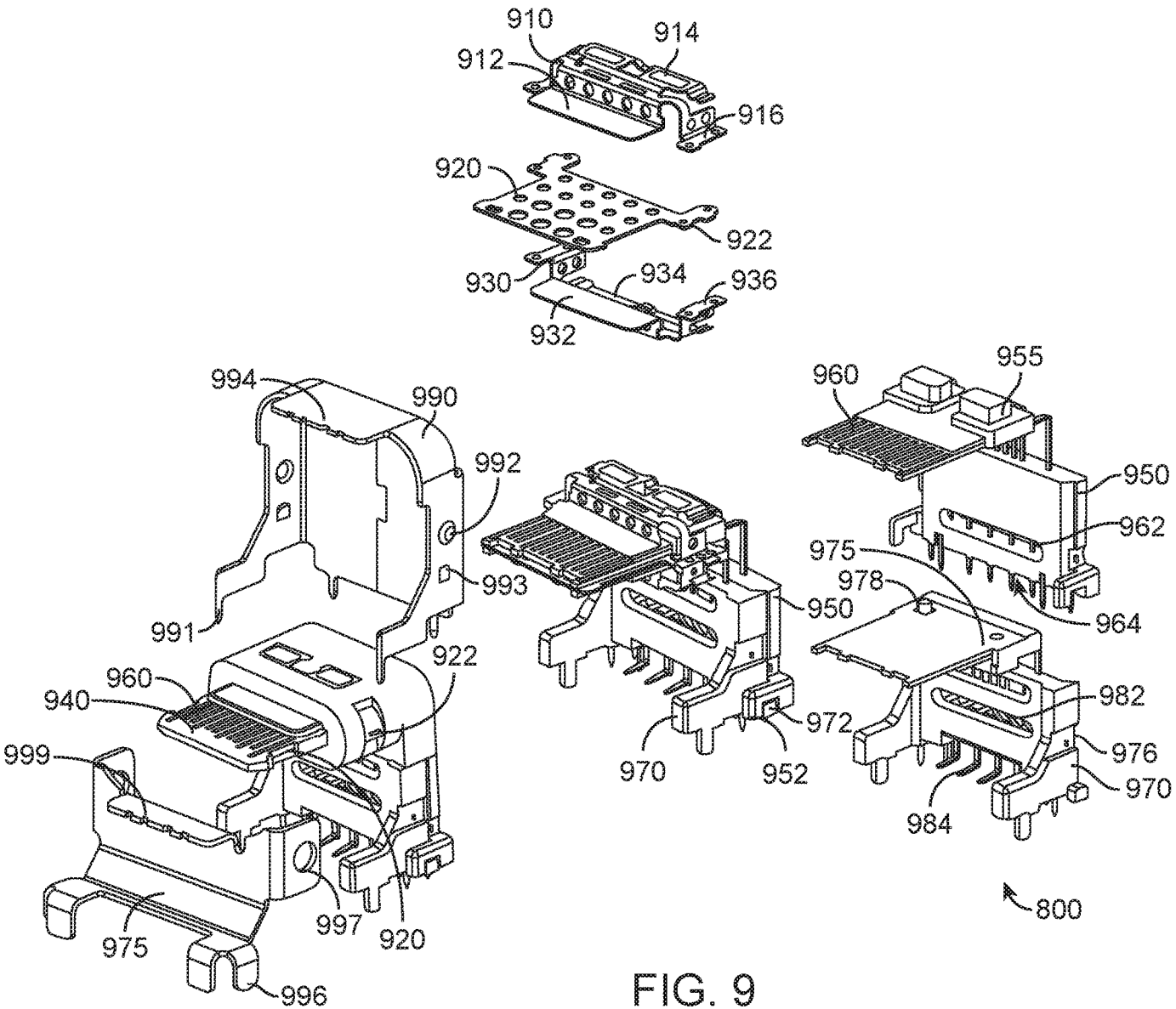
FIG. 9 illustrates a method of manufacturing a connector receptacle according to embodiments of the present invention.

Accordingly, embodiments of the present invention may provide an overmold or other layer that may be formed at least over leading edges 961 of contacts 960 and leading edges 981 of contacts 980 (shown in FIG. 9.) This overmold may fix contacts 960 and 980 to tongue 940. This overmold layer is shown in the following figure.

FIG. 9 illustrates a method of manufacturing a connector receptacle according to embodiments of the present invention. Top ground structure 910 may include ground contact 912, shield contact 914, as well as side tabs 916. Central ground plane 920 may include tabs 922. Bottom ground structure 930 may include ground contact 932, shield contact 934, as well as tabs 936. Tabs 916, 922, and 936 may be aligned and soldered or laser welded to each other.

Contacts 960 may include contacting portions, middle transition portions 962, and tail portions 964. Middle transition portions 962 may include angled portions to increase a spacing between contacts 960 such that tail portions 964 may be more readily attached to a printed circuit board or other appropriate substrate (not shown.)

Contacts 980 may include contacting portions, middle transition portions 982, and tail portions 984. Middle transition portions 982 may include angled portions to increase a spacing between contacts 980 such that tail portions 984 may be more readily attached to a printed circuit board or other appropriate substrate.

Contacts 960 may be partially housed in first housing 950 and second housing 955. Specifically, middle transition portions 962 may be housed in first housing 950, while contacting surfaces may be supported by second housing 955. First housing 950 may include inverted U-shaped portion 952. Contacts 980 may be partially housed in third housing 970 and fourth housing 975. Specifically, middle transition portions 982 may be housed in third housing 970 while contacting surfaces of contacts 980 may be supported by fourth housing 975. Third housing 970 may include ledge 976 and tab 972, while fourth housing 975 may include tab 978. Tab 978 may fit in an opening (not shown) in second housing 955. Inverted U-shaped portion 952 may fit over tab 972 to secure first housing 950 to third housing 970. Tongue 940 may be formed over the second housing 955 and fourth housing 975. Tongue 940 may be molded around the attached ground structures 910 and 930, and central ground plane 920. Tongue 940 may include slots 942 for accepting contacts 960 and 980. Tongue 940 may also include top ground contact 912, bottom ground contact 932, shield contact 914, and shield contact 934.

Connector receptacle 800 may be shielded by top shield 990 and bottom shield 995. Raised dimple 992 on top shield 990 may fit in opening 997 in bottom shield 995. Extension 994 of top shield 990 may be soldered or laser welded to shield contact 914. Tab 993 may fit against ledge 976 on third housing 970. Extension 999 may be soldered or laser welded to shield contact 934.

Leading edges 961 of contacts 960 and leading edges 981 of contacts 980 may be angled such that they are closer to tongue 940 near a leading edge of tongue 940. Leading edges 961 of contacts 960 and leading edges 981 of contacts 980 may be may covered by the mold used to form tongue 940. Tongue 940 may be a second injection molding in a two-shot molding process. Overmold 949 may prevent separation of contacts 960 and contacts 980 from tongue 940 when an incompatible connector insert is plugged into connector receptacle 800.

Figure 10:
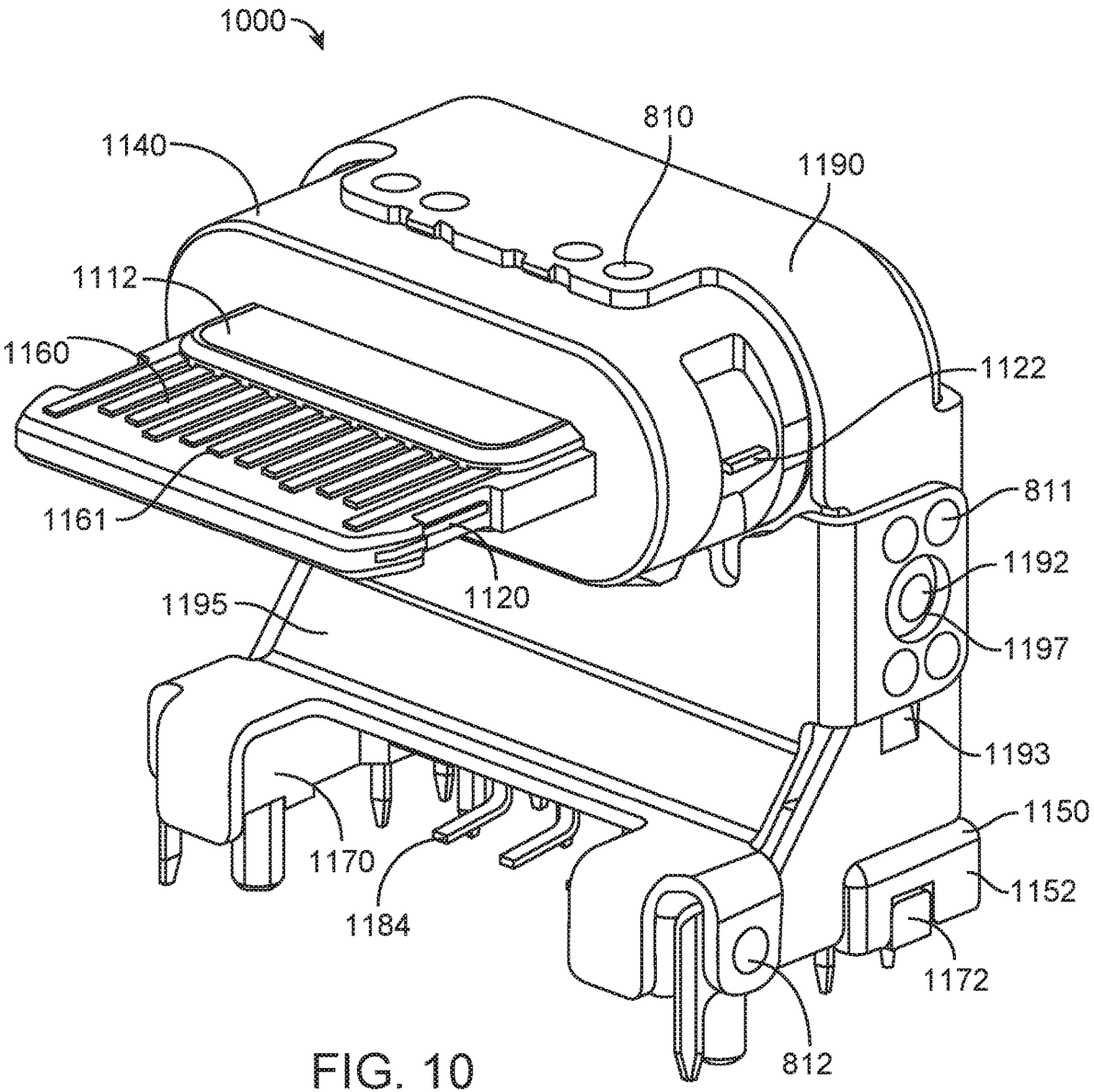
FIG. 10 illustrates a connector receptacle according to an embodiment of the present invention.

FIG. 10 illustrates a connector receptacle according to an embodiment of the present invention. Connector receptacle 1000 may be used as connector receptacle 110 or 350, or as another connector in these and other embodiments of the present invention. Connector receptacle 1000 may include a tongue 1140 supporting a number of contacts 1160 on a top side and a number of contacts 1180 on a bottom side (shown in FIG. 11.) Contacts 1160 may partially housed in first housing 1150, while contacts 1180 may be partially housed in third housing 1170. First housing 1150 may include inverted U-shaped portion 1152 for accepting tab 1172 of third housing 1170.

Ground contacts 1112 may be located on top and bottom sides of tongue 1140. Tongue 1140 may include a central ground plane 1120, which may form side contacts on tongue 1140 as well as side ground contacts or tab 1122. Contacts 1160 may include contacting portions on a surface of tongue 1140, where the contacting portions form electrical connections with contacts in a corresponding connector insert when the connector insert is mated with connector receptacle 1000. Contacts 1180 on the underside of tongue 1140 may also include tail portions 1184, which may be soldered to contacts or through holes on a printed circuit board or other appropriate substrate.

Connector receptacle 1000 may be shielded by a top shield 1190 and a bottom shield 1195. Top shield 1190 and bottom shield 1195 may be fixed to each by laser welding or other technique at locations 1010, 1011, and 1012. Raised dimple 1192 on top shield 1190 may fit in opening 1197 on bottom shield 1195. Tab 1193 may be secured against ledge 1176 (shown in FIG. 11.)

Again, an incompatible connector insert that is plugged into a connector receptacle 1000 may strike tongue 1140 deflecting it either and up or down direction. This may cause leading edges 1141 of contacts 1160 on a top side of tongue 1140, or leading edges (not shown) of contacts 1180 on a bottom side of tongue 1140, to separate from tongue 1140. Once separated, these contacts may be pushed backwards and bent or otherwise damaged.

Figure 11:
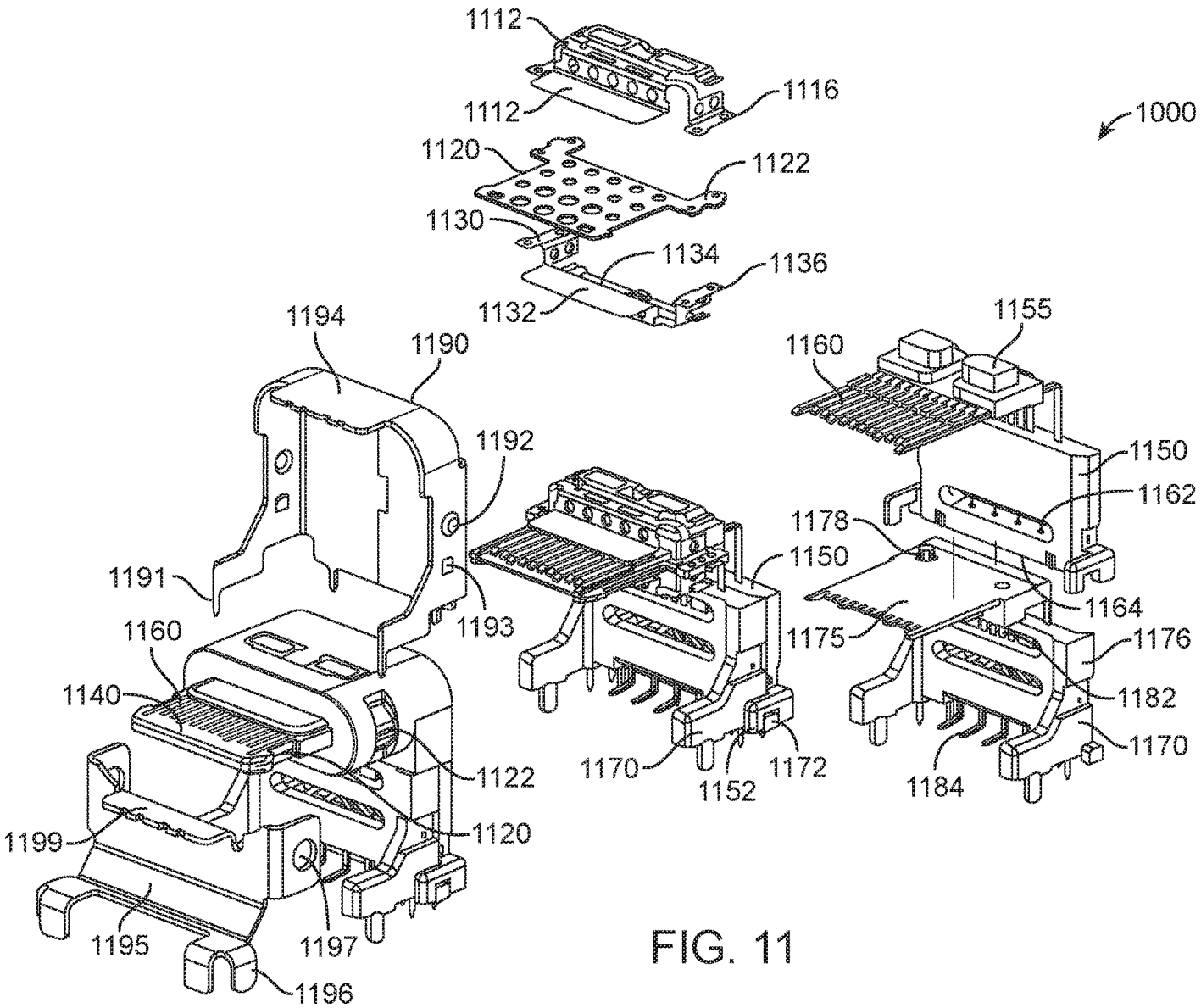
FIG. 11 illustrates a method of manufacturing a connector receptacle according to embodiments of the present invention.

Accordingly, embodiments of the present invention may provide an overmold or other layer that may be formed at least over leading edges 1161 of contacts 1160 and leading edges 1181 of contacts 1180 (shown in FIG. 11.) This overmold may fix contacts 1160 and 1180 to tongue 1140. This overmold layer is shown in the following figure.

FIG. 11 illustrates a method of manufacturing a connector receptacle according to embodiments of the present invention. Top ground structure 1110 may include ground contact 1112, shield contact 1114, as well as side tabs 1116. Central ground plane 1120 may include tabs 1122. Bottom ground structure 1130 may include ground contact 1132, shield contact 1134, as well as tabs 1136. Tabs 1116, 1122, and 1136 may be aligned and soldered or laser welded to each other.

Contacts 1160 may include contacting portions, middle transition portions 1162, and tail portions 1164. Middle transition portions 1162 may include angled portions to increase a spacing between contacts 1160 such that tail portions 1164 may be more readily attached to a printed circuit board or other appropriate substrate (not shown.)

Contacts 1180 may include contacting portions, middle transition portions 1182, and tail portions 1184. Middle transition portions 1182 may include angled portions to increase a spacing between contacts 1180 such that tail portions 1184 may be more readily attached to a printed circuit board or other appropriate substrate.

Contacts 1160 may be partially housed in first housing 1150 and second housing 1155. Specifically, middle transition portions 1162 may be housed in first housing 1150, while contacting surfaces may be supported by second housing 1155. First housing 1150 may include inverted U-shaped portion 1152. Contacts 1180 may be partially housed in third housing 1170 and fourth housing 1175. Specifically, middle transition portions 1182 may be housed in third housing 1170 while contacting surfaces of contacts 1180 may be supported by fourth housing 1175. Third housing 1170 may include ledge 1176 and tab 1172, while fourth housing 1175 may include tab 1178. Tab 1178 may fit in an opening (not shown) in second housing 1155. Inverted U-shaped portion 1152 may fit over tab 1172 to secure first housing 1150 to third housing 1170. Tongue 1140 may be formed over the second housing 1155 and fourth housing 1175. Tongue 1140 may be molded around the attached ground structures 1110 and 1130, and central ground plane 1120. Tongue 1140 may include slots 1142 for accepting contacts 1160 and 1180. Tongue 1140 may also include top ground contact 1112, bottom ground contact 1132, shield contact 1114, and shield contact 1134.

Connector receptacle 1000 may be shielded by top shield 1190 and bottom shield 1195. Raised dimple 1192 on top shield 1190 may fit in opening 1197 in bottom shield 1195. Extension 1194 of top shield 1190 may be soldered or laser welded to shield contact 1114. Tab 1193 may fit against ledge 1176 on third housing 1170. Extension 1199 may be soldered or laser welded to shield contact 1134.

Leading edges 1161 of contacts 1160 and leading edges 1181 of contacts 1180 may be angled such that they are closer to tongue 1140 near a leading edge of tongue 1140. Leading edges 1161 of contacts 1160 and leading edges 1181 of contacts 1180 may be may covered by the mold used to form tongue 1140. Tongue 1140 may be a second injection molding in a two-shot molding process. Overmold 1149 may prevent separation of contacts 1160 and contacts 1180 from tongue 1140 when an incompatible connector insert is plugged into connector receptacle 1000.

These and other embodiments of the present invention may provide connector receptacle tongues where leading edges of contacts on the tongue are protected behind a cross-beam or other structure. The cross-beam may be part of a frame. The frame may be metallic or other durable material. The cross-beam may shield leading edges of the contacts to prevent them from being separated from the tongue when a connector insert for a first type of connector system is inserted into a connector receptacle for a second type of connector system. An example is shown in the following figure.

Figure 12:
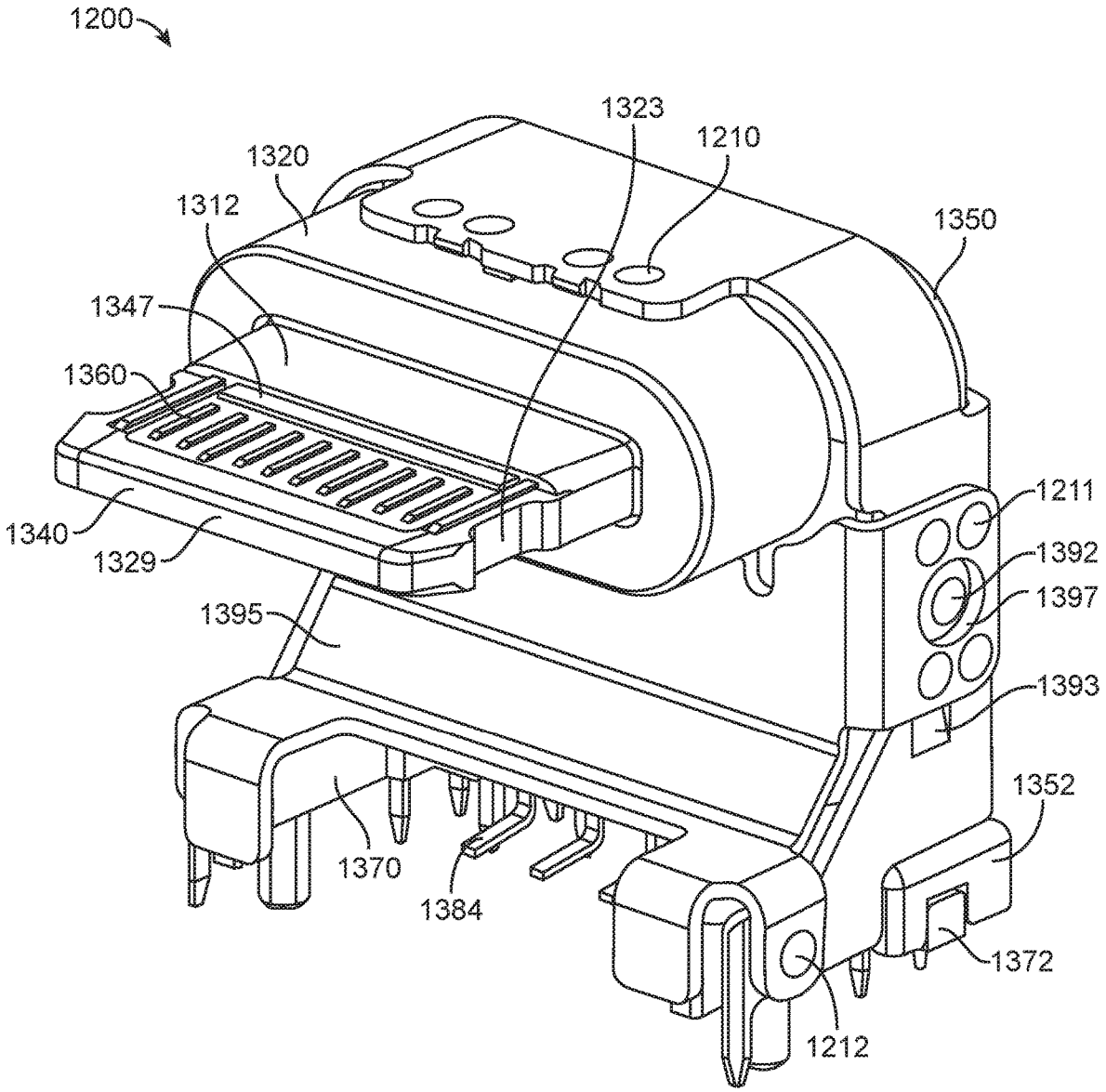
FIG. 12 illustrates a connector receptacle according to an embodiment of the present invention.

FIG. 12 illustrates a connector receptacle according to an embodiment of the present invention. Connector receptacle

1200 may be used as connector receptacle 110 or 350, or as another connector in these and other embodiments of the present invention. Connector receptacle 1200 may include a tongue 1340 supporting a number of contacts 1360 on a top side and a number of contacts 1380 on a bottom side (shown in FIG. 13.) Contacts 1360 may partially housed in first housing 1350, while contacts 1380 may be partially housed in second housing 1370. First housing 1350 may include inverted U-shaped portion 1352 for accepting tab 1372 of second housing 1370.

Tongue 1340 may be outlined by frame 1320. Frame 1320 may include side portions 1323 and front cross-beam 1327 (shown in FIG. 13.) Front cross-beam 1327 may be overmolded with overmold 1329. Ground contacts 1312 may be located on top and bottom sides of tongue 1340. Contacts 1360 may include contacting portions on a surface of tongue 1340, where the contacting portions form electrical connections with contacts in a corresponding connector insert when the connector insert is mated with connector receptacle 1200. Contacts 1380 on the underside of tongue 1340 may also include tail portions 1384, which may be soldered to contacts or through holes on a printed circuit board or other appropriate substrate.

Connector receptacle 1200 may be shielded by a top shield 1390 and a bottom shield 1395. Top shield 1390 and bottom shield 1395 may be fixed to each by laser welding or other technique at locations 1210, 1211 and 1212. Raised dimple 1392 on top shield 1390 may fit in opening 1397 on bottom shield 1395. Tab 1393 may be secured against ledge 1376 (shown in FIG. 13.)

Again, an incompatible connector insert that is plugged into a connector receptacle 1200 may strike tongue 1340 deflecting it either and up or down direction. This may cause leading edges 1341 of contacts 1360 on a top side of tongue 1340, or leading edges (not shown) of contacts 1380 on a bottom side of tongue 1340, to separate from tongue 1340. Once separated, these contacts may be pushed backwards and bent or otherwise damaged.

Figure 13:
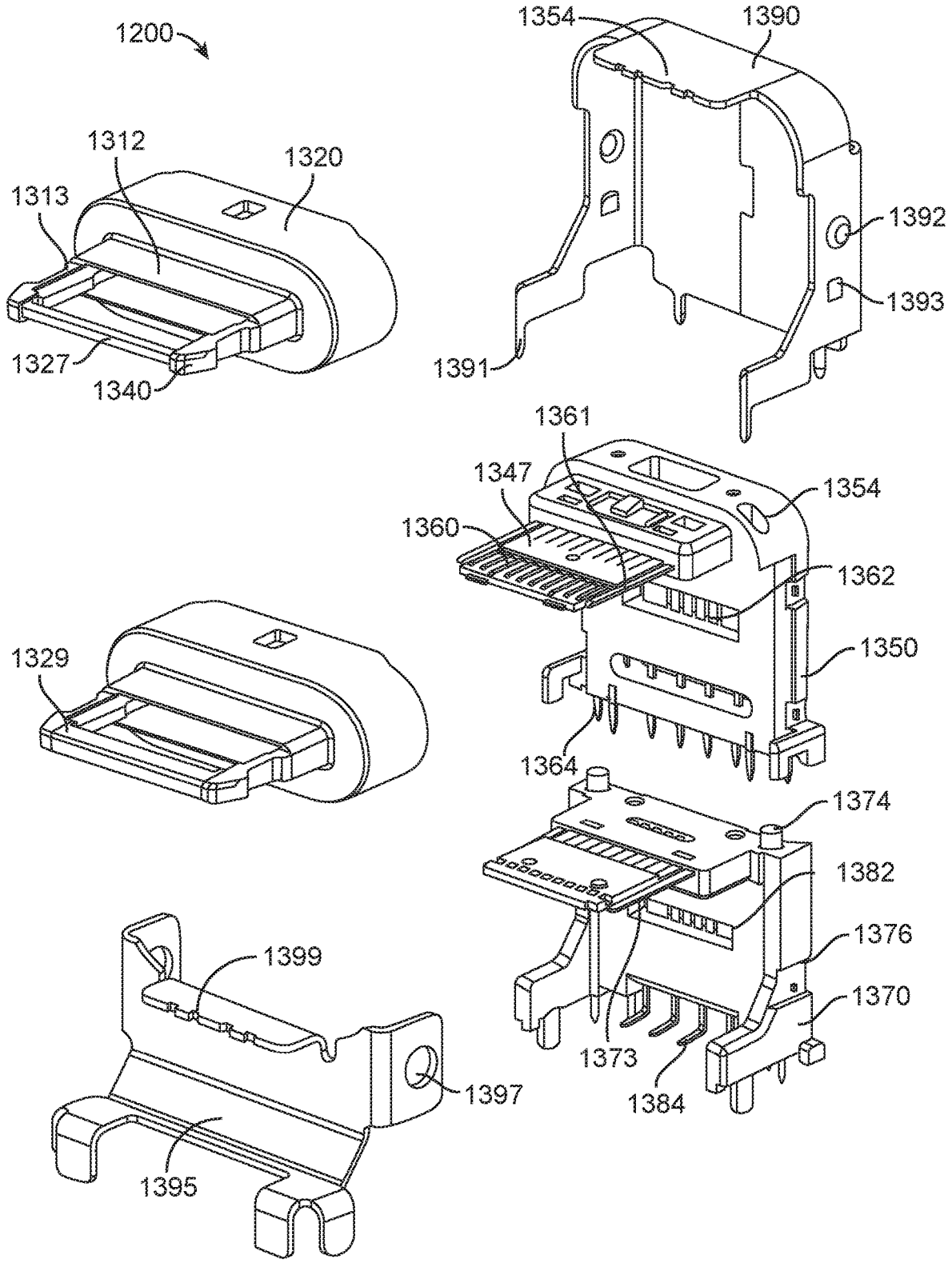
FIG. 13 illustrates a method of manufacturing a connector receptacle according to embodiments of the present invention.

Accordingly, embodiments of the present invention may provide an overmolded cross-beam or other structures that may protect at least over leading edges 1361 of contacts 1360 and leading edges 1381 of contacts 1380 (shown in FIG. 13.) This overmolded cross-beam may fix contacts 1360 and 1380 to tongue 1340. This overmolded cross-beam is shown in the following figure.

FIG. 13 illustrates a method of manufacturing a connector receptacle according to embodiments of the present invention. Frame 1320 may include side portions 1323 coupled together by front cross-beam 1327. Front cross-beam 1327 may be overmolded with overmold 1329. Frame 1320 may further include top and bottom ground contacts 1322.

Contacts 1360 may include contacting portions, middle transition portions 1362, and tail portions 1364. Middle transition portions 1362 may include angled portions to increase a spacing between contacts 1360 such that tail portions 1364 may be more readily attached to a printed circuit board or other appropriate substrate (not shown.)

Contacts 1380 may include contacting portions, middle transition portions 1382, and tail portions 1384. Middle transition portions 1382 may include angled portions to increase a spacing between contacts 1380 such that tail portions 1384 may be more readily attached to a printed circuit board or other appropriate substrate.

Contacts 1360 may be partially housed in first housing 1350. Specifically, middle transition portions 1362 may be housed in first housing 1350. First housing 1350 may include passage 1354 and inverted U-shaped portion 1352. Contacts 1380 may be partially housed in second housing 1370. Specifically, middle transition portions 1382 may be housed in second housing 1370. Second housing 1370 may include ledge 1376, tab 1372, and tab 1374. Tab 1374 may fit in passage 1354 in first housing 1350. Inverted U-shaped portion 1352 may fit over tab 1372 to secure first housing 1350 to second housing 1370. Contacts 1360 and 1380 may be inserted into tongue 1340 such that contacts 1360 and 1380 are located in slots 1342 on top and bottom sides of tongue 1340.

Connector receptacle 1200 may be shielded by top shield 1390 and bottom shield 1395. Raised dimple 1392 on top shield 1390 may fit in opening 1397 in bottom shield 1395. Extension 1394 of top shield 1390 may be soldered or laser welded to shield contact 1314. Tab 1393 may fit against ledge 1376 on second housing 1370. Extension 1399 may be soldered or laser welded to shield contact 1334.

Leading edges 1361 of contacts 1360 and leading edges 1381 of contacts 1380 may be protected by front cross-beam 1327 and overmold 1329. Tongue 1340 may be a second injection molding in a two-shot molding process. Front cross-beam 1327 and overmold 1329 may prevent separation of contacts 1360 and contacts 1380 from tongue 1340 when an incompatible connector insert is plugged into connector receptacle 1200.

During the insertion of a connector insert (not shown) into connector receptacle 1200, side retention springs (not shown) in sides of an opening in the connector insert may engage side portions 1323 of frame 1320. Also, contacts in the connector insert may engage ground contacts 1312. This may cause wear and may cause the generation of conductive metallic particles (not shown). That is, the physical contact of the metallic surfaces may cause abrasion, chipping, or other damage. These conductive particles, which may be supplemented by other conductive particles from other sources, may form conductive paths between individual contacts 1360 and 1380, and between contacts 1360 and 1380 and ground contacts 1312.

These particles may accumulate in accumulation zones on connector tongue 1340. Specifically, ground contacts in the connector insert may physically and electrically contact ground contacts 1312 on a top and bottom of connector tongue 1340. During repeated insertions, these connector insert ground contact may sweep these particles up against front edges of ground contacts 1312. This may cause the particles to accumulate between contacts 1360 and 1380, and between contacts 1360 and 1380 and ground contacts 1312. Without more, these particles may form electrical connections between and among contacts 1360 and 1380, between one or more contacts 1360 or 1380 and ground contacts 1312, or both.

Accordingly, insulative moldings 1347 may be formed over portions of contacts 1360 and 1380. These insulative moldings 1347 may prevent or reduce the creation of undesirable conductive paths. Conductive particles that gather in accumulation zones between contacts 1360 and 1380 may be electrically isolated from each other and from ground contacts 1312 and might not cause electrical connections to form. While conductive particles that gather between contacts 1360 and 1380 and ground contacts 1312 may electrically connect to ground contacts 1312, they are electrically isolated from contacts 1360 and 1380 and might not cause electrical connections to form between contacts 1360 and 1380 and between contacts 1360 and 1380 and ground contacts 1312. Insulative moldings 1347 may be formed by injection molding or other technique.

In these and other embodiments of the present invention, ground contacts 1369, as with the other contacts, may include tail portions, which may be attached to a printed circuit board or other appropriate substrate. In these and other embodiments of the present invention, ground contacts 1369 or other ground contacts may instead be soldered or otherwise electrically connected to frame 1320. An example is shown in the following figure.

Figure 14:
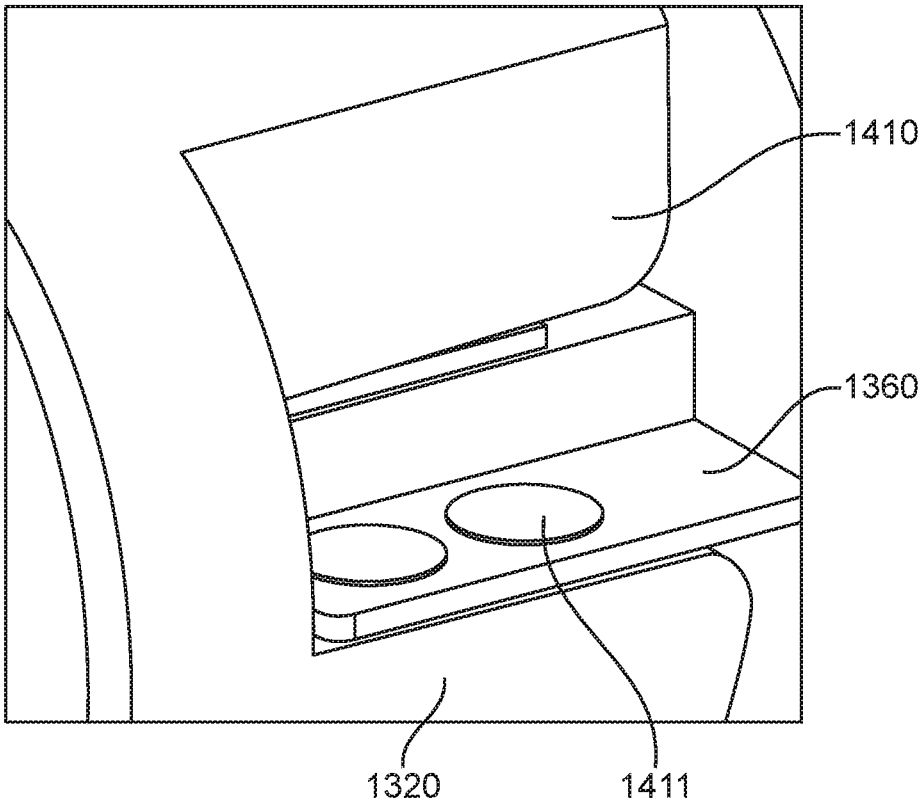
FIG. 14 illustrates a portion of a connector receptacle according to an embodiment of the present invention.

FIG. 14 illustrates a portion of a connector receptacle according to an embodiment of the present invention. In this example, notch 1410 may be formed in frame 1320. Ground contact 1369 may be soldered or laser welded to frame 1320 at locations 1411.

These connector receptacles may undergo further assembly processes after these adhesive layers or overmolds are formed. These process may cause contacts on a tongue to become separated from the tongue, making eventual damage more likely. Accordingly, these and other embodiments of the present invention may provide a reflow cap that may be used to secure contacts to a tongue of a connector receptacle during electronic device assembly, shipping, or other times. An example is shown in the following figures.

Figure 15:
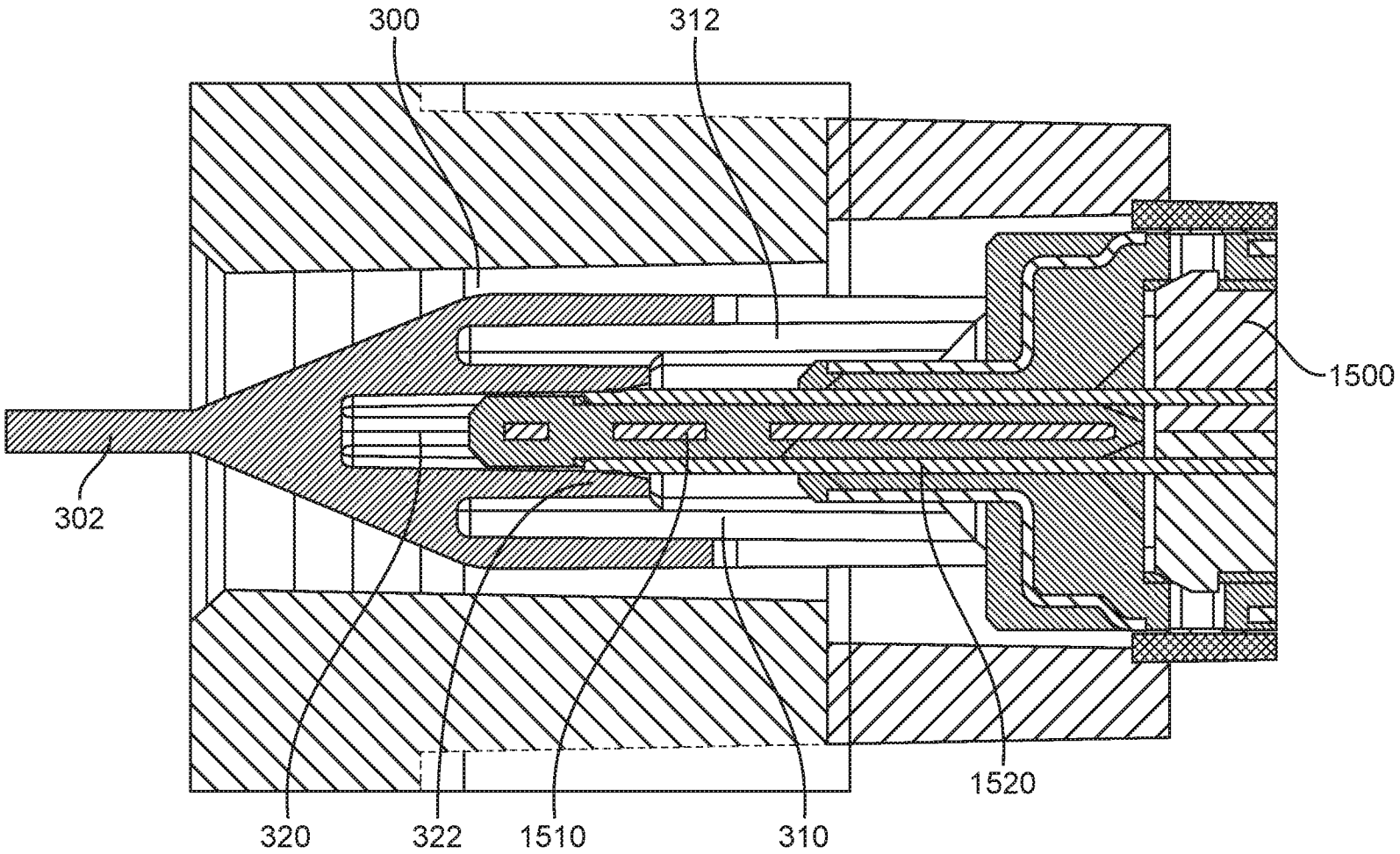
FIG. 15 illustrates a cross-section of a reflow cap according to an embodiment of the present invention.

FIG. 15 illustrates a cross-section of a reflow cap according to an embodiment of the present invention. Tongue 1510 of connector receptacle 1500 may fit in a central passage 310 of reflow cap 300. Reflow cap 300 may include a plurality of ribs 312 to secure the tongue 1510 to reflow cap 300. Recess 320 in central passage 310 may accept a leading edge of tongue 1510. Recess 320 sidewalls 322 in central passage 310 may apply pressure on tongue 1510 to hold contacts 1520 against tongue 1510 during assembly. This may prevent contacts 1520 from lifting away from tongue 1510. Reflow cap 300 may include tab 302 near a front, wherein tab 302 may be used in automated removal of reflow cap 300 after assembly, shipping, or other time. Reflow cap 300 may be similarly used with the other connector receptacles shown here or with these and other connector receptacles in these and other embodiments of the present invention.

Figure 16A:
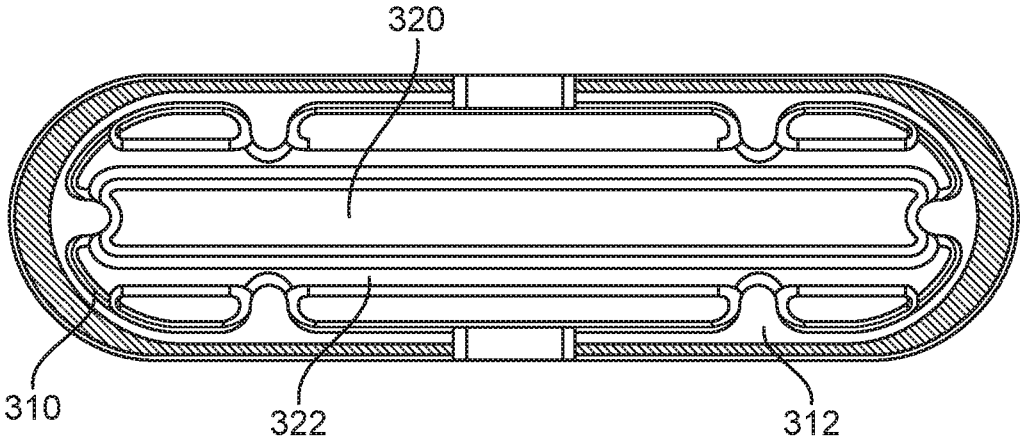
FIGS. 16A-16B illustrate a rear view and an oblique view of a reflow cap according to an embodiment of the present invention.
Figure 16B:
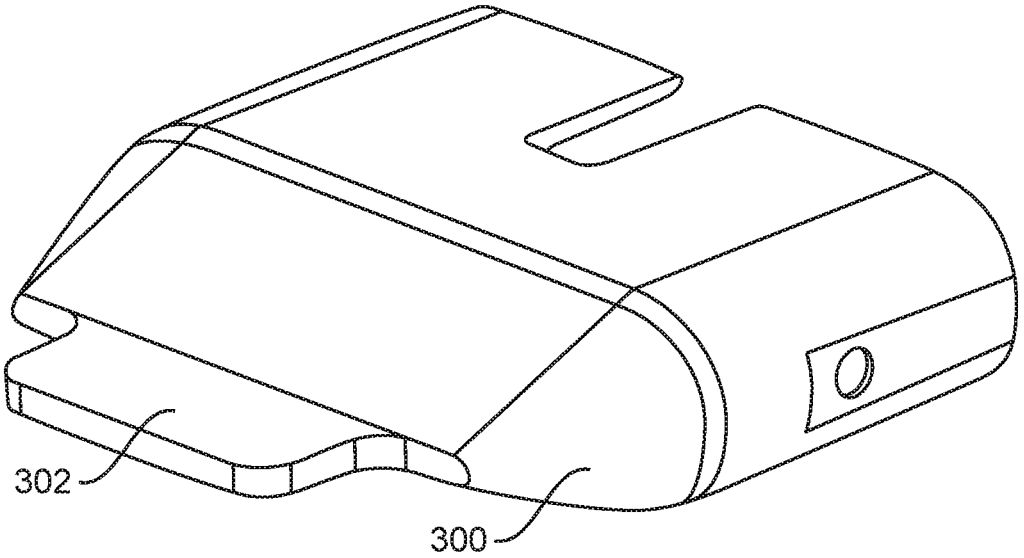

FIGS. 16A-16B illustrate a rear view and an oblique view of a reflow cap according to an embodiment of the present invention. In FIG. 16A, reflow cap 300 may include central passage 310 for accepting a tongue of a connector receptacle. Ribs 312 in central passage 310 may hold the tongue in place in reflow cap 300. Recess 320 may accept a leading edge of the tongue. Sidewalls 322 of recess 320 may provide a force to hold contacts on the tongue against the tongue during assembly, shipping or other times. In FIG. 16B, reflow cap 300 may include tab 302 near a front, wherein tab 302 may be used in automated removal of reflow cap 300 after assembly, shipping or other time.

Connector receptacles and connector inserts may have various form factors. For example, a connector receptacle may include a tongue in a recess, where a corresponding connector insert fits in the recess and has an opening that accepts the connector receptacle tongue. In another example, a connector insert may include a tongue or may be formed as a tongue that fits in a connector receptacle. In these and other connector configurations a connector tongue is used. An example of a connector receptacle that includes a tongue is shown in the following figure.

Figure 17:
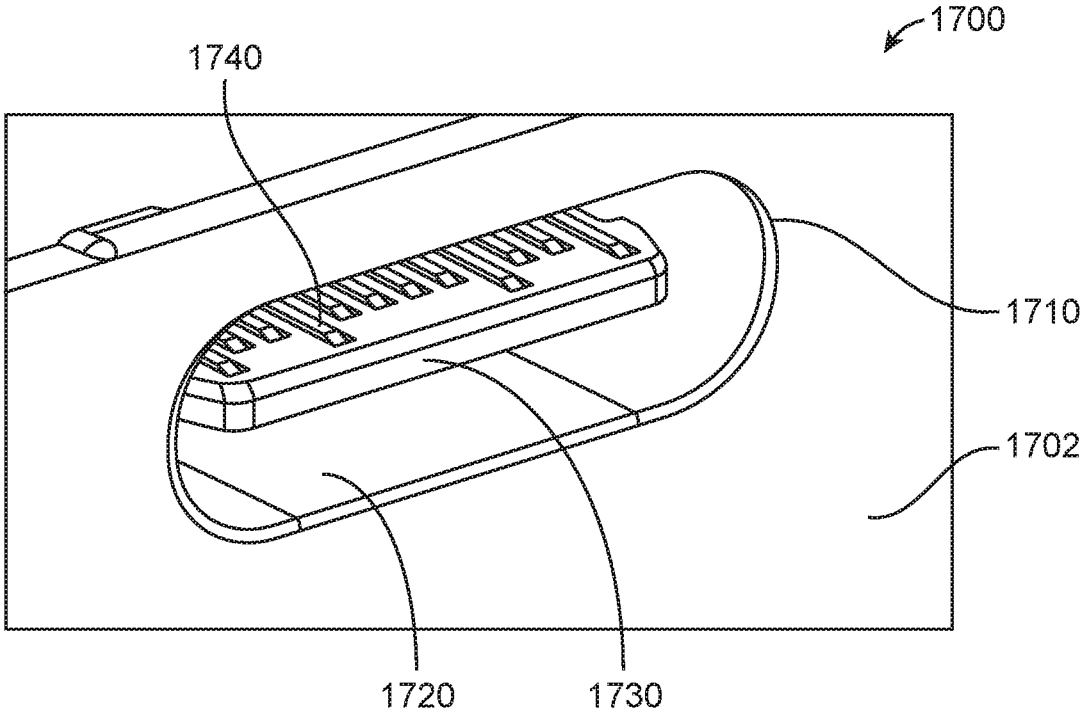
FIG. 17 illustrates a connector receptacle according to an embodiment of the present invention.

FIG. 17 illustrates a connector receptacle according to an embodiment of the present invention. Connector receptacle 1700 may include connector tongue 1730 in recess 1720 in device enclosure 1702. Recess 1720 may form opening 1710 at a surface of device enclosure 1702. Contacts 1740 may be supported by connector tongue 1730.

Various types of connector tongues may be used as connector tongue 1730 in connector receptacle 1700. Also, connector tongues may be used as portions of connector inserts as well as connector receptacles. An example of a connector tongue 1730 that may be used in connector receptacle 1700 is shown in the following figures.

Figure 18:
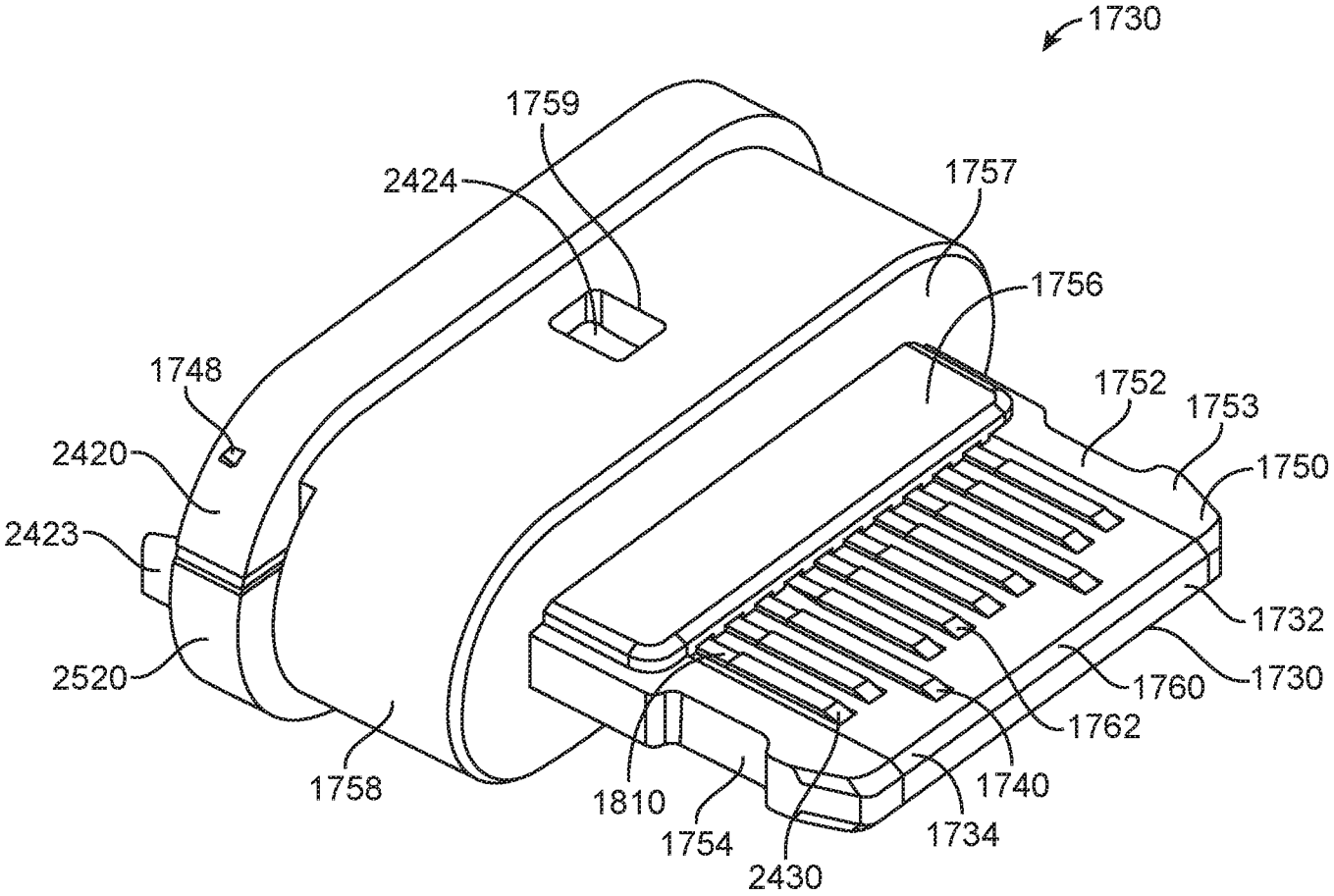
FIG. 18 illustrates a connector tongue for a connector receptacle according to an embodiment of the present invention.

FIG. 18 illustrates a connector tongue for a connector receptacle according to an embodiment of the present invention. Connector tongue 1730 may include frame 1750. Frame 1750 may provide a connector tongue 1730 that is durable, has good wear performance, and provides a constant level of performance. Frame 1750 may include notches 1754 on each frame side 1752, where the frame sides 1752 are adjacent to sides and between the top and bottom sides of tongue molding 1760. Frame sides 1752 may form a portion of frame 1750 that extends along sides of connector tongue 1730. Frame sides 1752 may be joined near a rear of the connector tongue by frame support 1758. When the connector tongue is used in a USB Type-C connector receptacle, ground pads 1756 may extend along a top and bottom of the connector tongue 1730 joining frame sides 1752 at face 1757 of frame support 1758. Face 1757 of frame support 1758 may act as a rear surface of connector receptacle 1700 (shown in FIG. 17).

In these and other embodiments of the present invention, a cross-beam 1751 (shown in FIG. 19) at or near a front 1732 of connector tongue 1730 may join frame sides 1752 together. Cross-beam 1751 may be covered by tongue molding 1760 to reduce wear on corresponding connecters that are mated with connector tongue 1730. Tongue molding 1760 may be an overmold that may prevent contacts on a corresponding connector (not shown) from being shorted or grounded by the cross-beam 1751 when the corresponding connector is mated with connector tongue 1730. A front 1732 of connector tongue 1730 may be chamfered to form edge 1734, which may simplify mating to a corresponding connector.

In these and other embodiments of the present invention, frame 1750 may be metallic or ceramic, it may be metallic coated with a ceramic, or it may be formed of other material. Frame 1750 may increase a strength of connector tongue 1730 as compared to a connector tongue formed only of tongue molding 1760. Frame 1750 may have good wear performance. A metal frame 1750 may be oxidized or coated with a ceramic or other material at a surface for an increased lubricity for even better wear performance. This oxidation or coating may be selective such that portions, such as frame sides 1752 including ground contacts 1753 and notches 1754, as well as ground pads 1756, are not oxidized or coated such that they may make electrical contact with corresponding features on a corresponding connector (not shown) when the corresponding connector is mated with connector tongue 1730. Specifically, ground pads 1756 may be exposed such that they may make electrical contact with ground contacts near a front of a USB Type-C connector insert (not shown). Notches 1754 may be exposed such that they make electrical contact with side retention springs (not shown) in sides of an opening in a USB Type-C connector insert. In these and embodiments of the present invention, the coating or oxidation may be done using physical vapor deposition (PVD), ion injection, or other process technique. In one example, a titanium frame 1750 may be at least partially oxidized to form titanium-oxide on at least a part of the surface of frame 1750. The use of these materials for frame sides 1752 of frame 1750 may also provide a clear tactile and audible response to a user when a user mates a connector having connector tongue 1730 with a corresponding connector, as compared to a plastic or printed circuit board tongue without frame sides 1752.

In various embodiments of the present invention, frame 1750 may be made in different ways. For example, frame 1750 may be formed using metal-injection molding, 3-D printing, forging, stamping, or other process.

Connector tongue 1730 may further include tongue molding 1760. Tongue molding 1760 may be located between frame sides 1752. Tongue molding 1760 may include grooves 1762. Contacts 1740 may be located in grooves 1762 of tongue molding 1760. Tongue molding 1760 may be formed of plastic or other nonconductive materials. In various embodiments of the present invention, tongue molding 1760 may be made in different ways. For example, tongue molding 1760 may be formed using injection molding, 3-D printing, or other process.

Contacts 1740 may include a set of top contacts 2430 on a top side of tongue molding 1760 and a set of bottom set of contacts 2530 (shown in FIG. 25) on a bottom side of tongue molding 1760. Top set of contacts 2430 may be held together by top contact housing 2420 while bottom set of contacts 2530 may be held together by bottom contact housing 2520. Top contact housing 2420 may include posts 2423, which may fit in opening 1759 of frame 1750. A corresponding tab and opening may be found on the bottom of frame support 1758. Tabs 2424 and openings 1759 may secure top contact housing 2420 and bottom contact housing 2520 in place in frame support 1758. Bottom contact housing 2520 may include posts 2524. Posts 2524 may be inserted into an opening in a printed circuit board (not shown) for mechanical stability. Contacts 1740 may terminate in through-hole contact portions 1748. Through-hole contact portions 1748 may be inserted into openings in a printed circuit board (not shown) to form electrical connections with traces and pads supported by the printed circuit board.

During the insertion of a connector insert (not shown) into connector receptacle 1700 (shown in FIG. 17), side retention springs (not shown) in sides of an opening in the connector insert engage frame sides 1752 of frame 1750 on connector tongue 1730. Also, contacts in the connector insert may engage ground contacts 1753 on surfaces of frame side 1752. This may cause wear and may cause the generation of conductive metallic particles (not shown). These conductive particles, which may be supplemented by other conductive particles from other sources, may form conductive paths between contacts 1740 and between contacts 1740 and ground pads 1756. Accordingly, an insulative layer 1810 may be formed over portions of contacts 1740. Further details are shown in the following figure.

Figure 19:
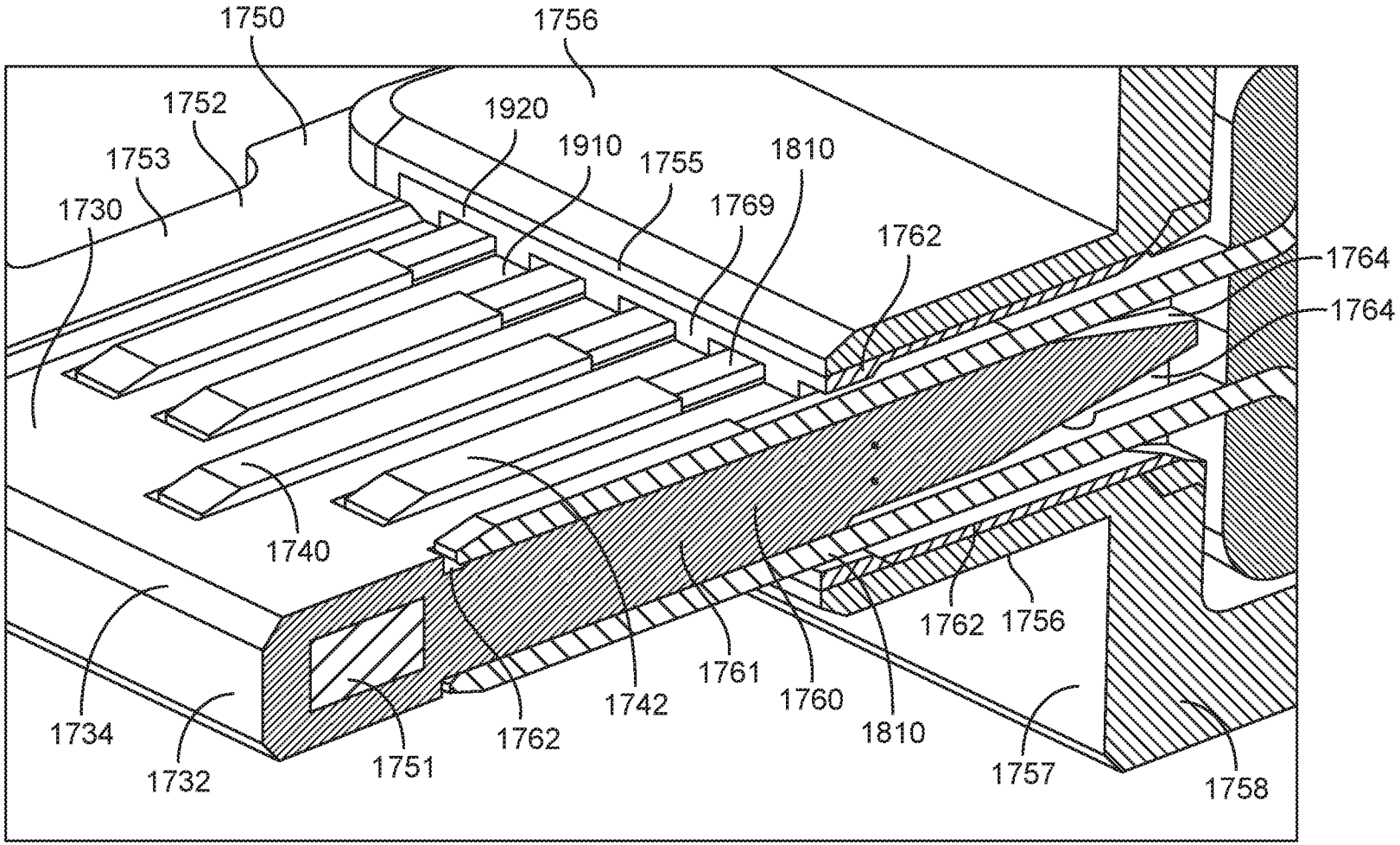
FIG. 19 is a close-up cutaway view of a portion of a connector tongue for a connector receptacle according to an embodiment of the present invention.

FIG. 19 is a close-up cutaway view of a portion of a connector tongue for a connector receptacle according to an embodiment of the present invention. Connector tongue 1730 may include frame 1750. Frame 1750 may include frame sides 1752, ground pads 1756, and frame support 1758. A face 1757 of frame support 1758 may form a bottom of recess 1720 of connector receptacle 1700 (shown in FIG. 17). Tongue molding 1760 may be formed between frame sides 1752 and may be formed around cross-beam 1751. Tongue molding 1760 may include grooves 1762. Grooves 1762 may support contacts 1740. Tongue molding 1760 may further include top and bottom portions and a tongue molding main portion 1761. Passages 1764 may be located between each of tongue molding 1760 top and bottom portions and tongue molding main portion 1761. Passages 1764 may be tapered to simplify the insertion of contacts 1740 during assembly of connector tongue 1730. A front 1732 of connector tongue 1730 may include chamfered edges 1734 to simplify the mating of a connector receptacle, such as connector receptacle 1700 and a connector insert (not shown). Contacts 1740 may include front portions or contacting portions 1742. Front portions or contacting portions 1742 may mate with contacts in a corresponding connector insert (not shown) when the connector insert is mated with a connector receptacle that includes connector tongue 1730.

Again, during the insertion of a connector insert (not shown) into connector receptacle 1700 (shown in FIG. 17), side retention springs (not shown) in sides of an opening in the connector insert may engage frame sides 1752 of frame 1750 on connector tongue 1730. Also, contacts in the connector insert may engage ground contacts 1753 on surfaces of frame sides 1752. The physical contact of the metallic surfaces may cause abrasion, chipping, or other damage. This may cause wear and may cause the generation of conductive metallic particles (not shown). These conductive particles may be supplemented by other conductive debris that may find its way into or onto the connectors. These particles may accumulate in accumulation zones on connector tongue 1730. Specifically, ground contacts in the connector insert may physically and electrically contact ground pads 1756 on a top and bottom of connector tongue 1730. During repeated insertions, these connector insert ground contact may sweep these particles up against front 1732 of tongue molding 1760 and front edges 1755 of ground pads 1756. This may cause the particles to accumulate in accumulation zones 1910 between contacts 1740 and accumulation zones 1920 between contacts 1740 and ground pad 1756. Without more, these particles may form electrical connections between and among contacts 1740, between one or more contacts 1740 and ground pads 1756, or both.

Put another way, ground pad 1756 and tongue molding 1760 may form a structure where the contacting portions of contacts 1740 are between a front 1732 of connector tongue 1730 and the structure. The front edges 1755 of ground pad 1756 and 1769 of tongue molding 1760 may form a surface of the structure, where the structure is at an angle to a surface of the tongue molding main portion 1761. This angle is shown here as a right angle, though this angle may also be an oblique angle. The angle of the surface of the structure relative to a surface of the tongue molding main portion 1761 may create accumulation zones. For example, the right angle between the front edges 1755 of ground pad 1756 and 1769 of tongue molding 1760 to a surface of tongue molding main portion 1761 may form accumulation zones 1910 and 1920.

Accordingly, insulative layers 1810 may be formed over portions of contacts 1740. These insulating layers 1810 may prevent or reduce the creation of undesirable conductive paths. Conductive particles that gather in accumulation zones 1910 between contacts 1740 may be electrically isolated from contacts 1740 and might not cause electrical connections to form between contacts 1740. While conductive particles that gather in accumulation zones 1920 between contacts 1740 and ground pads 1756 may electrically connect to ground pads 1756, they are electrically isolated from contacts 1740 and might not cause electrical connections to form between contacts 1740 and ground pads 1756.

Insulating layers 1810 may be formed by printing or other mechanical step or other process. In an illustrative embodiment of the present invention, insulating layers 1810 may be formed around portions of contacts 1740 or other connector structures by applying ink or other nonconductive material using printing, such as ink-jet type printing, 3-D printing, aerosol-jet printing, pad printing, or other types of printing.

In these and other embodiments, the ink may be nonconductive. This ink may be comparatively thick for improved wear performance. The ink may be a liquid, paste, or other substance, though pastes may more readily provide a thicker coverage. The thickness of the ink may be increased by printing the insulating layers on the contacts multiple times. The ink may be formed of a colorant and a binder. The binder may allow the colorant to adhere to one or more surfaces of the contacts or other connector structures. The colorant may be a dye or pigment. Pigments may include organic or inorganic particles. The pigments may provide color and may also provide improved wear performance.

In various embodiments of the present invention substances such as resins, lubricants, surfactants, thinners, hardeners, retarders, and solvents may be included in the ink to improve adhesion, wear performance, chemical resistance, resistance to thermal shock and extended high-temperatures, and other characteristics. For example, a hardener may be used. The hardener may be mixed with the ink in a ratio of 100 parts ink to between 1 and 10 parts hardener, for example in a 100:5 ratio. The hardener may be mixed with the ink in a ratio of 100 parts ink to between 11 and 20 parts hardener, for example in a 100:15 ratio. The hardener may be mixed with the ink in a ratio of 100 parts ink to between 21 and 30 parts hardener, for example in a 100:25 ratio. Other ranges and values of ratios may be used in these and other embodiments of the present invention. As another example, a solvent may be used. The solvent may be mixed with the ink in a ratio of 100 parts ink to between 1 and 15 parts solvent. The solvent may be mixed with the ink in a ratio of 100 parts ink to between 5 and 20 parts solvent. The solvent may be mixed with the ink in a ratio of 100 parts ink to between 10 and 25 parts solvent. The solvent may be mixed with the ink in a ratio of 100 parts ink to between 15 and 30 parts solvent. Other ranges of ratios may be used in these and other embodiments of the present invention.

Inks used in embodiments of the present invention may provide a good adhesion to the surfaces of the metallic contacts and it may provide a high level of insulation. These inks may provide a high level of resistance to chemicals to protect the ink in case of exposure to liquids such as alcohol, soda, or others. Some of these contacts may experience extended heating due to current flow and thermal shocks due to changes in the current flow as devices are connected and disconnected, as well as powered up and powered off. Accordingly, inks used in embodiments of the present invention may be able to withstand both changes in temperature (thermal shock) and extended periods of heating (heat soak.)

In various embodiments of the present invention, the ink used to form insulating layers 1810 may have various colors or combinations of colors. The ink may be colored to match or mismatch tongue molding 1760 or other connector portion. The ink may be transparent, translucent, partially opaque, or opaque. In one example, the ink may be white to match a color of tongue molding 1760. The ink may provide a finish that is matt, glossy, or it may provide a finish that is somewhere between the two.

In various embodiments of the present invention, the ink may have various thicknesses. In one embodiment of the present invention, each contact 1740 may be 1750 microns wide and located in a groove 1762 in tongue molding 1760 that is 300 microns wide. Contacts 1740 may each have a side adjacent to tongue molding 1760. This side may remain ink-free. The opposite and adjacent sides may be coated with a 25 micron layer of ink. The addition of the ink insulating layer 1810 to contacts 1740 may help to center contacts 1740 in grooves 1762 for improved alignment and improved reliability. Further details are shown in the following figure.

Figure 20:
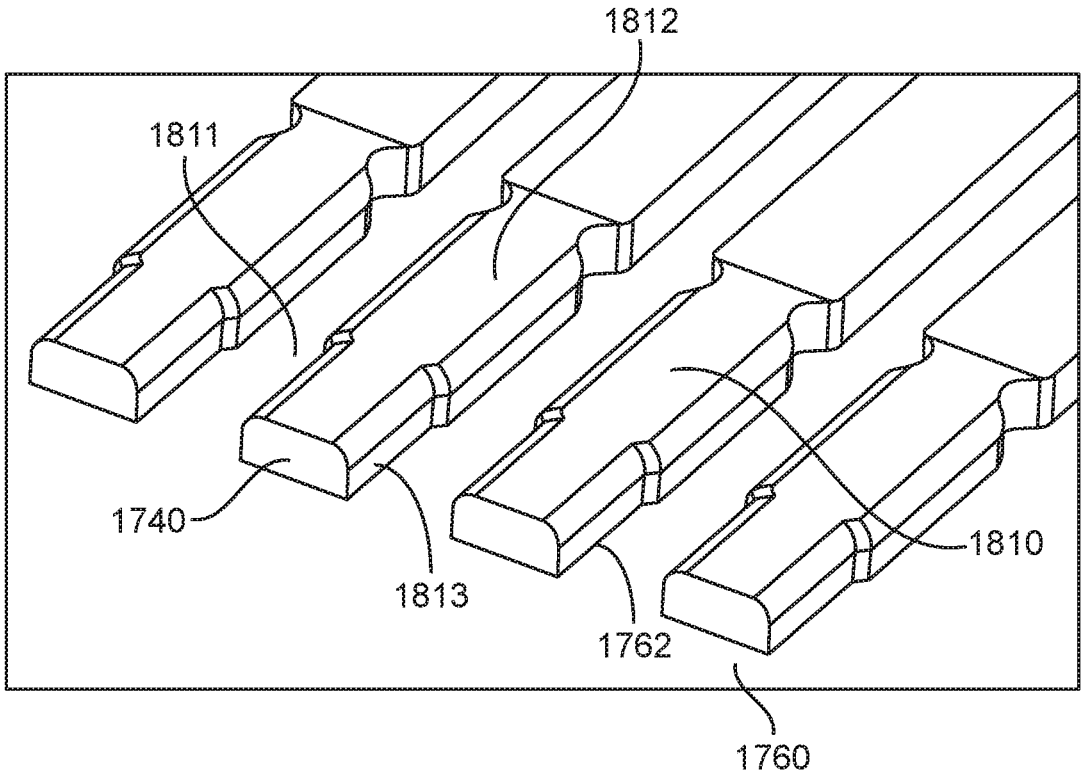
FIG. 20 is a close-up cutaway view of a portion of a connector tongue for a connector receptacle according to an embodiment of the present invention.

FIG. 20 is a close-up cutaway view of a portion of a connector tongue for a connector receptacle according to an embodiment of the present invention. In this example, contacts 1740 may reside in grooves 1762 in tongue molding 1760. Portions of contacts 1740 may be coated with an insulating layer 1810. Specifically, sides 1811 and 1813, as well as top surface 1812 (the side away from tongue molding 1760) may be coated with insulating layer 1810. A bottom side of contacts 1740 (the side adjacent to tongue molding 1760) may remain uncoated by insulating layer 1810. This may allow contacts 1740 to remain flush with tongue molding 1760.

Figure 21:
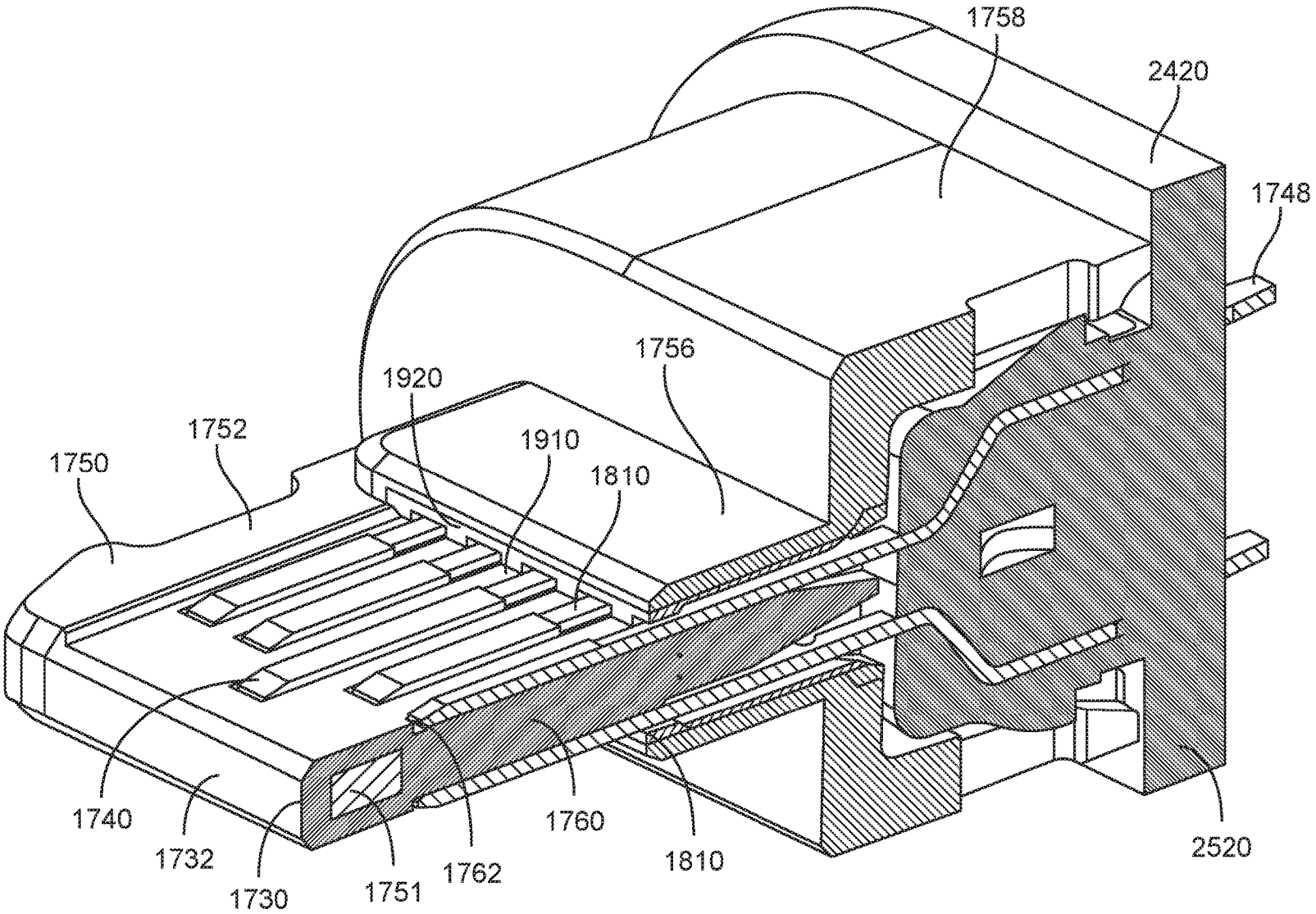
FIG. 21 is a cutaway view of a portion of a connector tongue for a connector receptacle according to an embodiment of the present invention.

FIG. 21 is a cutaway view of a portion of a connector tongue for a connector receptacle according to an embodiment of the present invention. Connector tongue 1730 may include frame 1750. Frame 1750 may include frame sides 1752, ground pads 1756, and frame support 1758. A face 1757 of frame support 1758 may form a rear of recess 1720 of connector receptacle 1700 (shown in FIG. 17). Tongue molding 1760 may be formed between frame sides 1752 and may be formed around cross-beam 1751. Tongue molding 1760 may include grooves 1762. Grooves 1762 may support contacts 1740.

Conductive particles may accumulate in accumulation zones 1910 between contacts 1740 and accumulation zones 1920 between contacts 1740 and ground pad 1756. Accordingly, insulative layers 1810 may be formed over portions of contacts 1740. These insulating layers 1810 may prevent or reduce the creation of undesirable conductive paths.

These connector tongues may be formed in various ways. An example is shown in the following figures.

Figure 22:
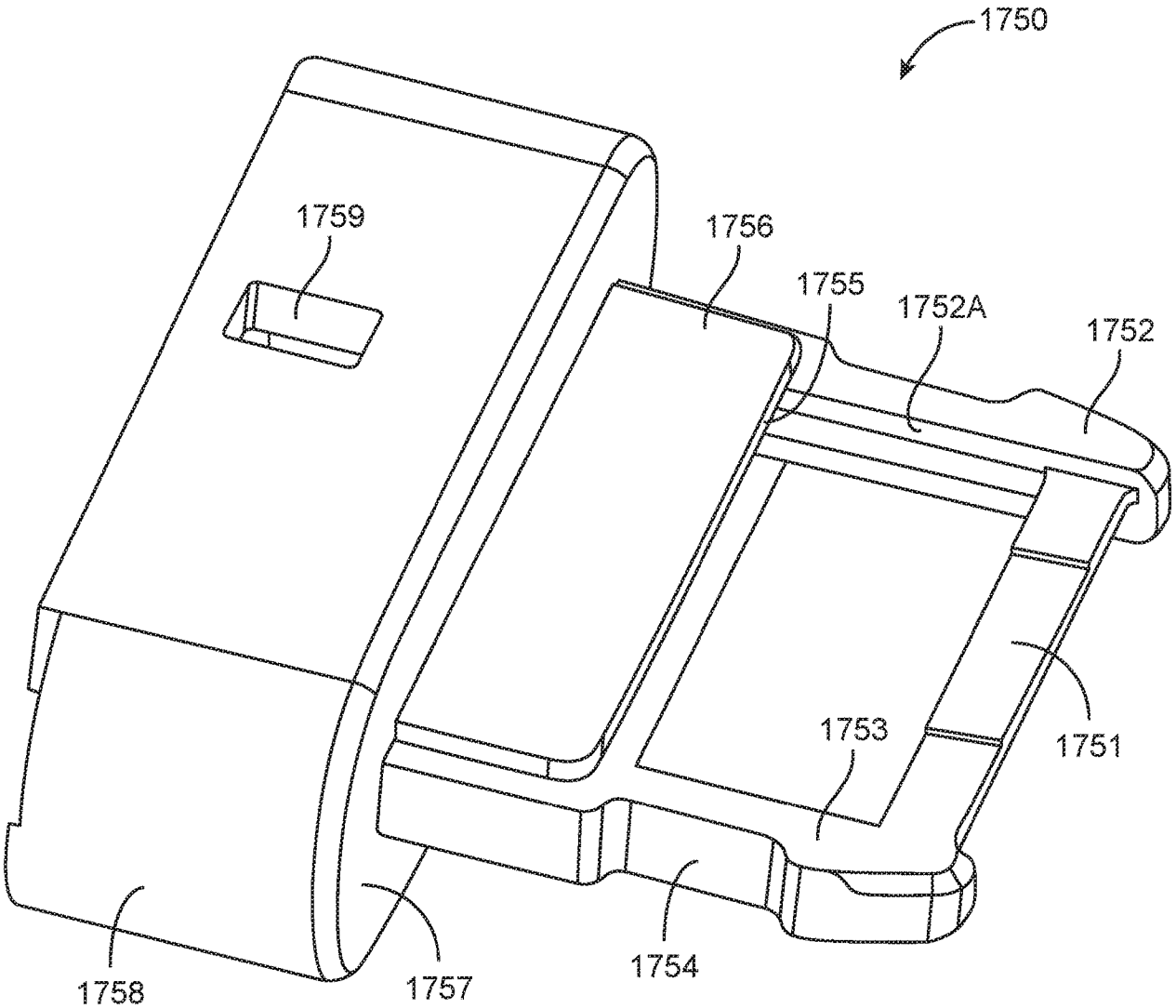
FIG. 22 illustrates a frame according to an embodiment of the present invention.

FIG. 22 illustrates a frame according to an embodiment of the present invention. Frame 1750 may include frame sides 1752. Frame sides 1752 may include side grooves 1752A. When tongue molding 1760 (shown in FIG. 18) is formed in frame 1750, tabs (not shown) of tongue molding 1760 may form tabs in side grooves 1752A. These interlocking tabs and grooves 1752A may help to support tongue molding 1760 in frame 1750. Cross-beam 1751 may join frame sides 1752. Frame sides 1752 may form ground contacts 1753 on top and bottom sides. Frame sides 1752 may include notches 1754, which may act as side retention features. Frame sides may terminate at face 1757 of frame support 1758. Ground pads 1756 may include front edges 1755 and may also terminate at face 1757 of frame support 1758. Frame support 1758 may include opening 1759. Frame 1750 may be formed of various materials, such as metal, ceramic, or other conductive or nonconductive material. In various embodiments of the present invention, frame 1750 may be made in different ways. For example, frame 1750 may be formed using metal-injection molding, 3-D printing, forging, stamping, or other process.

Figure 23:
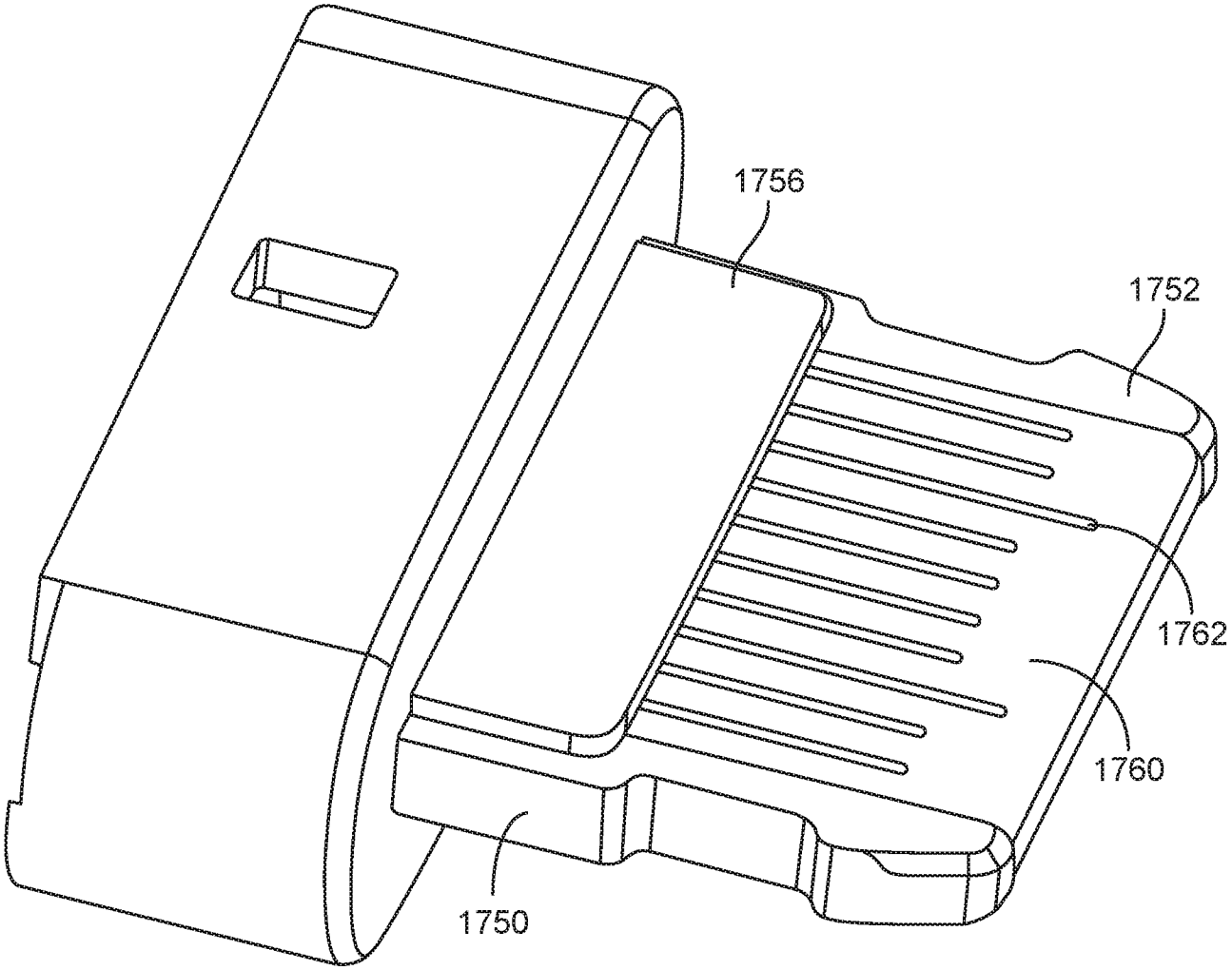
FIG. 23 illustrates a tongue molding formed in a frame according to an embodiment of the present invention.

FIG. 23 illustrates a tongue molding formed in a frame according to an embodiment of the present invention. Tongue molding 1760 may be formed in frame 1750. Tongue molding 1760 may extend between frame sides 1752 and below ground pads 1756. Grooves 1762 may be formed in tongue molding 1760 to support contacts 1740 (shown in FIG. 3). Tongue molding 1760 may be formed of plastic or other nonconductive material. In various embodiments of the present invention, tongue molding 1760 may be made in different ways. For example, tongue molding 1760 may be formed using injection molding, 3-D printing, or other process.

Figure 24:
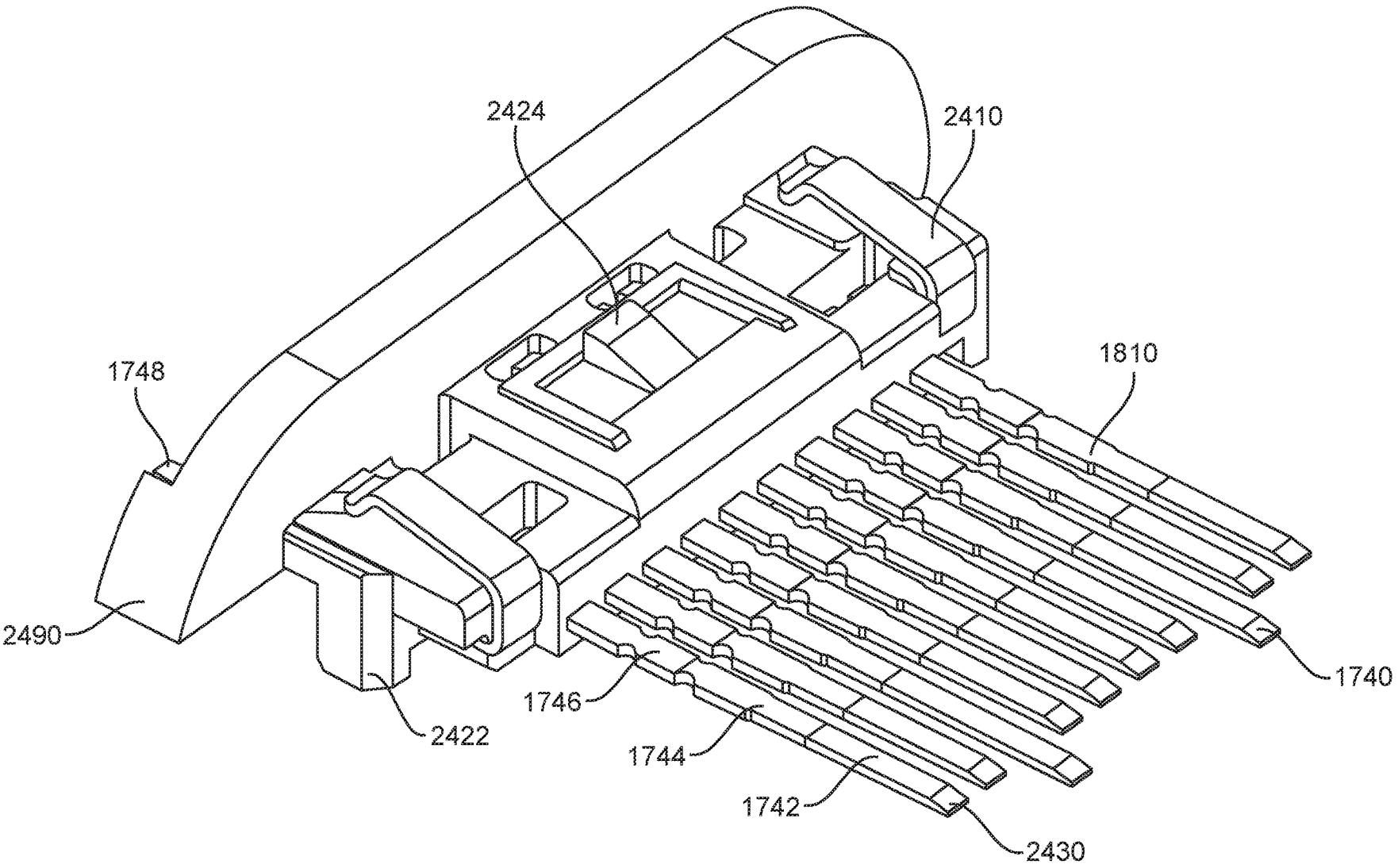
FIG. 24 illustrates a top contact housing formed around portions of a top set of contacts according to an embodiment of the present invention.

FIG. 24 illustrates a top contact housing formed around portions of a top set of contacts according to an embodiment of the present invention. Top contact housing 2420 may include tab 2424 to fit in opening 1759 in frame support 1758 (shown in FIG. 7). Top contact housing 2420 may further include tab 2422 to fit in notch 2522 (shown in FIG. 25) in bottom contact housing 2520 (shown in FIG. 21). Top contact housing 2420 may be formed of plastic or other material using injection molding or other process. Top contact housing 2420 may be formed around a rear portion of contacts 1740. Ground contacts 2410 may be folded over to form ground connections to frame support 1758 (shown in FIG. 22).

Top set of contacts 2430 may include contacts 1740. Contacts 1740 may include a front portion 1742 for forming electrical connections with contacts of a corresponding connector insert (not shown). Contacts 1740 may include a center portion 1744. Center portion 1744 may be coated on one or more sides with insulation layer 1810. A rear part of center portion 1744 may be located below ground pad 1756, while a front part of center portion 1744 may extend towards a front 1732 of connector tongue 1730 beyond ground pads 1756 (shown in FIG. 19). Contacts 1740 may further include rear portion 1746. Some of rear portion 1746 may be molded in top contact housing 2420, while another part may extend from top contact housing 2420. Insulating layer 1810 may be omitted from rear portion 1746 to avoid problems during molding of top contact housing 2420. Through-hole contact portions 1748 of contacts 1740 may emerge from a rear of top contact housing 2420. Through-hole contact portions 1748 may be soldered into a printed circuit board, flexible circuit board, or other appropriate substrate (not shown) to form electrical connections with traces and planes in the board. Contacts 1740 may be formed of copper or other material. Contacts 1740 may be stamped from a sheet of metal, 3-D printed, or formed in other ways.

Figure 25:
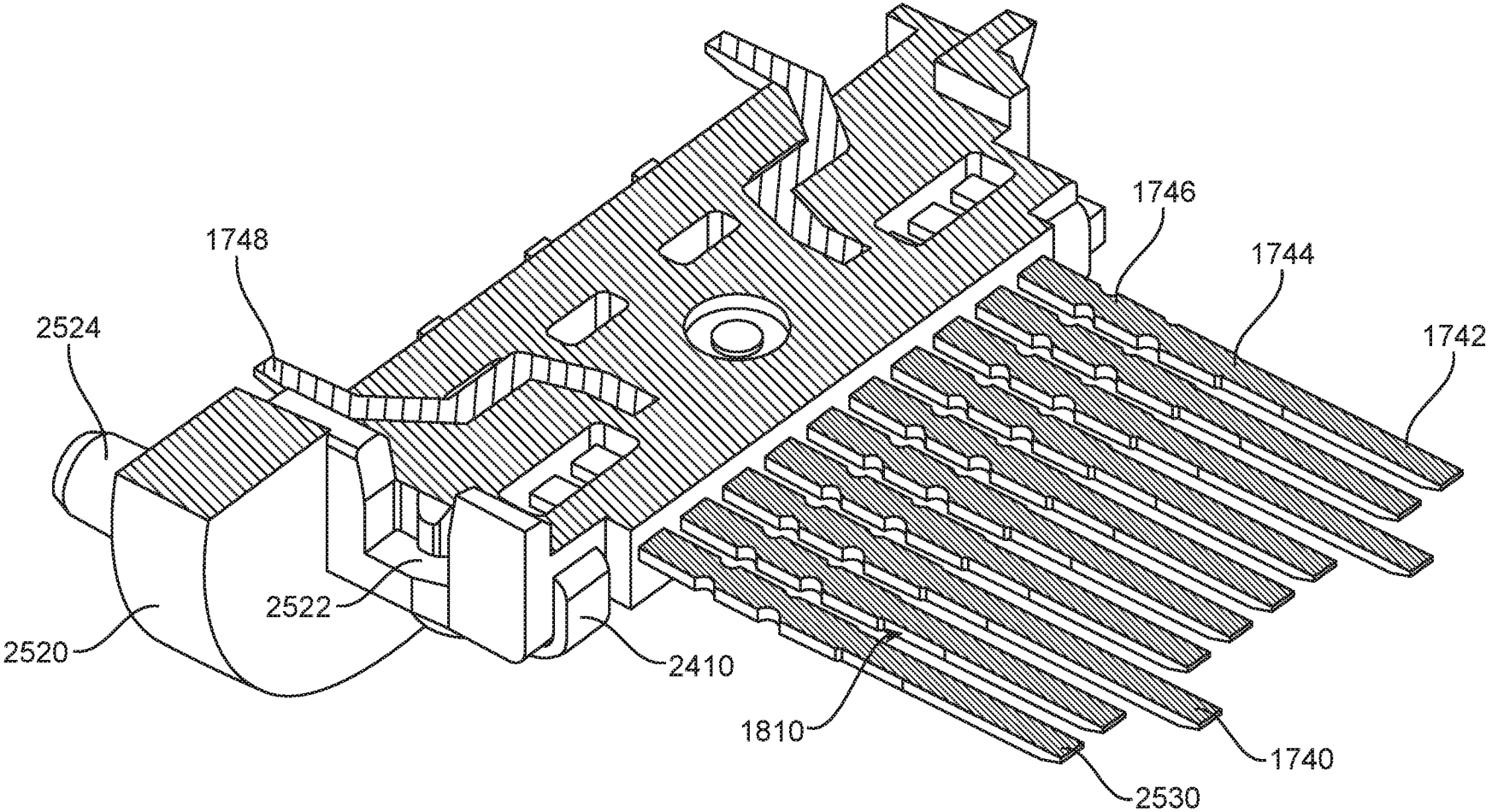
FIG. 25 illustrates a bottom contact housing formed around portions of a bottom set of contacts according to an embodiment of the present invention.

FIG. 25 illustrates a bottom contact housing formed around portions of a bottom set of contacts according to an embodiment of the present invention. Bottom contact housing 2520 may include a tab corresponding to tab 2424 (in FIG. 24) to fit in a notch corresponding to opening 1759 in frame support 1758 (shown in FIG. 24). Top contact housing 2420 may further include notch 2522 to accept tab 2422 (shown in FIG. 24) in top contact housing 2420 (shown in FIG. 21). Bottom contact housing 2520 may include posts 2524, which may be inserted into openings in a printed circuit board, flexible circuit board, or other appropriate substrate (not shown) for mechanical stability. Bottom contact housing 2520 may be formed of plastic or other material using injection molding or other process. Bottom contact housing 2520 may be formed around a rear portion of contacts 1740. Ground contacts 2410 may be folded over to form ground connections to frame support 1758 (shown in FIG. 22).

Bottom set of contacts 2530 may include contacts 1740. Contacts 1740 may include a front portion 1742 for forming electrical connections with contacts of a corresponding connector insert (not shown). Contacts 1740 may include a center portion 1744. Center portion 1744 may be coated on one or more sides with insulation layer 1810. A rear part of center portion 1744 may be located above ground pad 1756, while a front part of center portion 1744 may extend towards a front 1732 of connector tongue 1730 beyond ground pads 1756 (shown in FIG. 19). Contacts 1740 may further include rear portion 1746. Some of rear portion 1746 may be molded in bottom contact housing 2520, while another part may extend from bottom contact housing 2520. Insulating layer 1810 may be omitted from rear portion 1746 to avoid problems during molding of bottom contact housing 2520. Through-hole contact portions 1748 of contacts 1740 may emerge from a rear of bottom contact housing 2520. Through-hole contact portions 1748 may be soldered into a printed circuit board, flexible circuit board, or other appropriate substrate (not shown) to form electrical connections with traces and planes in the board.

Top contact housing 2420 (shown in FIG. 24) may be attached to bottom contact housing 2520 by inserting tab 2422 (shown in FIG. 24) into notch 2522. Top set of contacts 2430 (shown in FIG. 24) and bottom set of contacts 2530 may be inserted through passages 1764 in tongue molding 1760 and into grooves 1762 in tongue molding 1760 (shown in FIG. 19). Tabs 2424 on top contact housing 2420 (shown in FIG. 24) and a corresponding tab (not shown) on bottom contact housing 2520 may be fit in openings 1759 on a top side of frame support 1758 (shown in FIG. 18) and a corresponding opening on a bottom of frame support 1758. This may secure top set of contacts 2430 and bottom set of contacts 2530 in place in frame 1750 (shown in FIG. 18).

Again, various types of connector tongues may be used as connector tongue 1730 in connector receptacle 1700. Also, connector tongues may be used as portions of connector inserts as well as connector receptacles. Another example of a connector tongue 1730 that may be used in connector receptacle 1700 is shown in the following figures.

Figure 26:
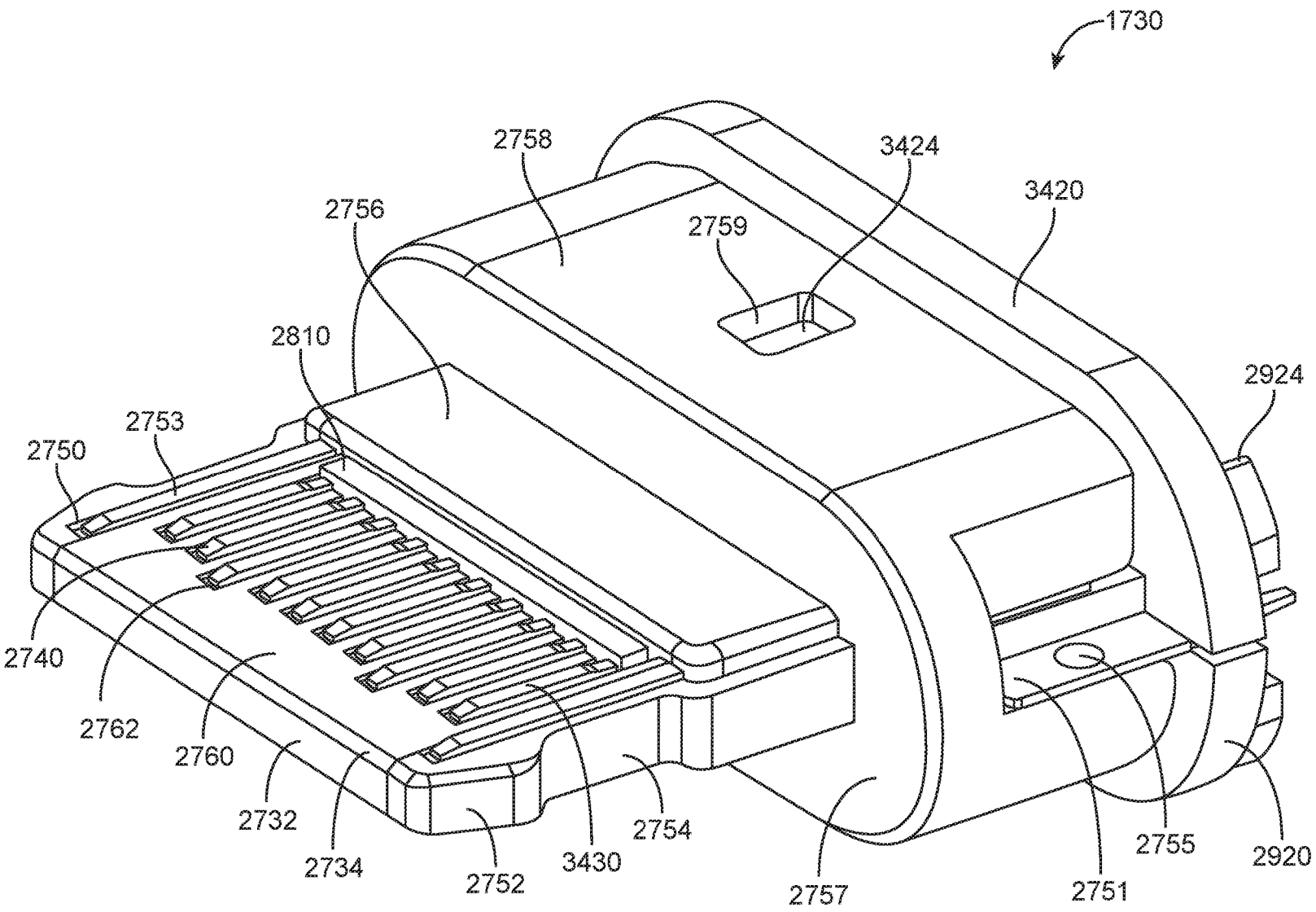
FIG. 26 illustrates another connector tongue for a connector receptacle according to an embodiment of the present invention.

FIG. 26 illustrates another connector tongue for a connector receptacle according to an embodiment of the present invention. Connector tongue 1730 may include frame 2750. Frame 2750 may provide a connector tongue 2730 that is durable, has good wear performance, and provides a constant level of performance. Frame 2750 may include notches 2754 on each frame side 2752, where the frame sides 2752 are adjacent to sides and between the top and bottom sides of tongue molding 2760. Frame sides 2752 may form a portion of frame 2750 that extends along sides of connector tongue 2730. Frame sides 2752 may be joined near a rear of the connector tongue by frame support 2758. When the connector tongue is used in a USB Type-C connector receptacle, ground pads 2756 may extend along a top and bottom of the connector tongue 2730 joining frame sides 2752 at face 2757 of frame support 2758. Face 2757 of frame support 2758 may act as a rear surface of connector receptacle 1700 (shown in FIG. 17).

In these and other embodiments of the present invention, a center ground plane 2751 (shown further in FIG. 27) in a center of connector tongue 1730 may connect to frame sides 2752. Center ground plane 2751 may be soldered to frame support 2758 at points 2755. Center ground plane 2751 may be covered by tongue molding 2760. Tongue molding 2760 may be an overmold over center ground plane 2751. A front 2732 of connector tongue 1730 may be chamfered to form edge 2733, which may simplify mating to a corresponding connector.

In these and other embodiments of the present invention, frame 2750 may be metallic or ceramic, it may be metallic coated with a ceramic, or it may be formed of other material. Frame 2750 may increase a strength of connector tongue 1730 as compared to a connector tongue formed only of tongue molding 2760. Frame 2750 may have good wear performance. A metal frame 2750 may be oxidized or coated with a ceramic or other material at a surface for an increased lubricity for even better wear performance. This oxidation or coating may be selective such that portions, such as frame sides 2752 including ground contacts 2753 and notches 2754, as well as ground pads 2756, are not oxidized or coated such that they may make electrical contact with corresponding features on a corresponding connector (not shown) when the corresponding connector is mated with connector tongue 1730. Specifically, ground pads 2756 may be exposed such that they may make electrical contact with ground contacts near a front of a USB Type-C connector insert (not shown). Notches 2734 may be exposed such that they make electrical contact with side retention springs (not shown) in sides of an opening in a USB Type-C connector insert. In these and embodiments of the present invention, the coating or oxidation may be done using physical vapor deposition (PVD), ion injection, or other process technique. In one example, a titanium frame 2750 may be at least partially oxidized to form titanium-oxide on at least a part of the surface of frame 2750. The use of these materials for frame sides 2752 of frame 2750 may also provide a clear tactile and audible response to a user when a user mates a connector having connector tongue 1730 with a corresponding connector, as compared to a plastic or printed circuit board tongue without frame sides 2752.

In various embodiments of the present invention, frame 2750 may be made in different ways. For example, frame 2750 may be formed using metal-injection molding, 3-D printing, forging, stamping, or other process.

Connector tongue 1730 may further include tongue molding 2760. Tongue molding 2760 may be located between frame sides 2752. Tongue molding 2760 may include grooves 2762. Contacts 2740 may be located in grooves 2762 of tongue molding 2760. Tongue molding 2760 may be formed of plastic or other nonconductive materials. In various embodiments of the present invention, tongue molding 2760 may be made in different ways. For example, tongue molding 2760 may be formed using injection molding, 3-D printing, or other process.

Contacts 2740 may include a set of top set 3430 of contacts 2740 on a top side of tongue molding 2760 and a set of bottom set 2930 of contacts 2740 (shown in FIG. 29) on a bottom side of tongue molding 2760. Top set 3430 of contacts 2740 may be held together by top contact housing 3420 while bottom set 2930 of contacts 2740 may be held together by bottom contact housing 2920. Top contact housing 3420 may include tab 3424, which may fit in opening 2759 of frame 2750. A corresponding tab and opening may be found on the bottom of frame support 2758. Tabs 3424 and openings 2759 may secure top contact housing 3420 and bottom contact housing 2920 in place in frame support 2758. Top contact housing 3420 and bottom contact housing 2920 may include posts 2924. Posts 2924 may be inserted into an opening in a printed circuit board (not shown) for mechanical stability. Contacts 2740 may terminate in through-hole contact portions (not shown.) Through-hole contact portions may be inserted into openings in a printed circuit board to form electrical connections with traces and pads supported by the printed circuit board.

During the insertion of a connector insert (not shown) into connector receptacle 1700 (shown in FIG. 17), side retention springs (not shown) in sides of an opening in the connector insert engage frame sides 2752 of frame 2750 on connector tongue 1730. Also, contacts in the connector insert may engage ground contacts 2753 on surfaces of frame side 2752. That is, the physical contact of the metallic surfaces may cause abrasion, chipping, or other damage. This may cause wear and may cause the generation of conductive metallic particles (not shown). These conductive particles, which may be supplemented by other conductive particles from other sources, may form conductive paths between individual contacts 2740 and between contacts 2740 and ground pads 2756.

These particles may accumulate in accumulation zones on connector tongue 1730. Specifically, ground contacts in the connector insert may physically and electrically contact ground pads 2756 on a top and bottom of connector tongue 1730. During repeated insertions, these connector insert ground contact may sweep these particles up against front edges of ground pads 1756. This may cause the particles to accumulate in accumulation zones 1910 (shown in FIG. 19) between contacts 2740 and accumulation zones 1920 (shown in FIG. 19) between contacts 2740 and ground pad 2756. Without more, these particles may form electrical connections between and among contacts 2740, between one or more contacts 2740 and ground pads 2756, or both.

Put another way, ground pad 2756 and tongue molding 2760 may form a structure where the contacting portions of contacts 2740 are between a front 2732 of connector tongue 1730 and the structure. The front edges of ground pad 2756 may form a surface of the structure, where the structure is at an angle to a surface of the tongue molding main portion 1761. This angle is shown here as a right angle, though this angle may also be an oblique angle. The angle of the surface of the structure relative to a surface of the tongue molding 2760 may create accumulation zones. For example, the right angle between the front edges of ground pad 2756 and a surface of tongue molding 2760 may form accumulation zones 1910 and 1920 (shown in FIG. 19.)

Accordingly, insulative moldings 2810 may be formed over portions of contacts 2740. These insulative moldings 2810 may prevent or reduce the creation of undesirable conductive paths. Conductive particles that gather in accumulation zones 1910 between contacts 1740 may be electrically isolated from contacts 1740 and might not cause electrical connections to form between contacts 2740. While conductive particles that gather in accumulation zones 1920 between contacts 2740 and ground pads 2756 may electrically connect to ground pads 2756, they are electrically isolated from contacts 2740 and might not cause electrical connections to form between contacts 2740 and between contacts 2740 and ground pads 2756.

Insulative moldings 2810 may be formed by injection molding or other technique.

Figure 27:
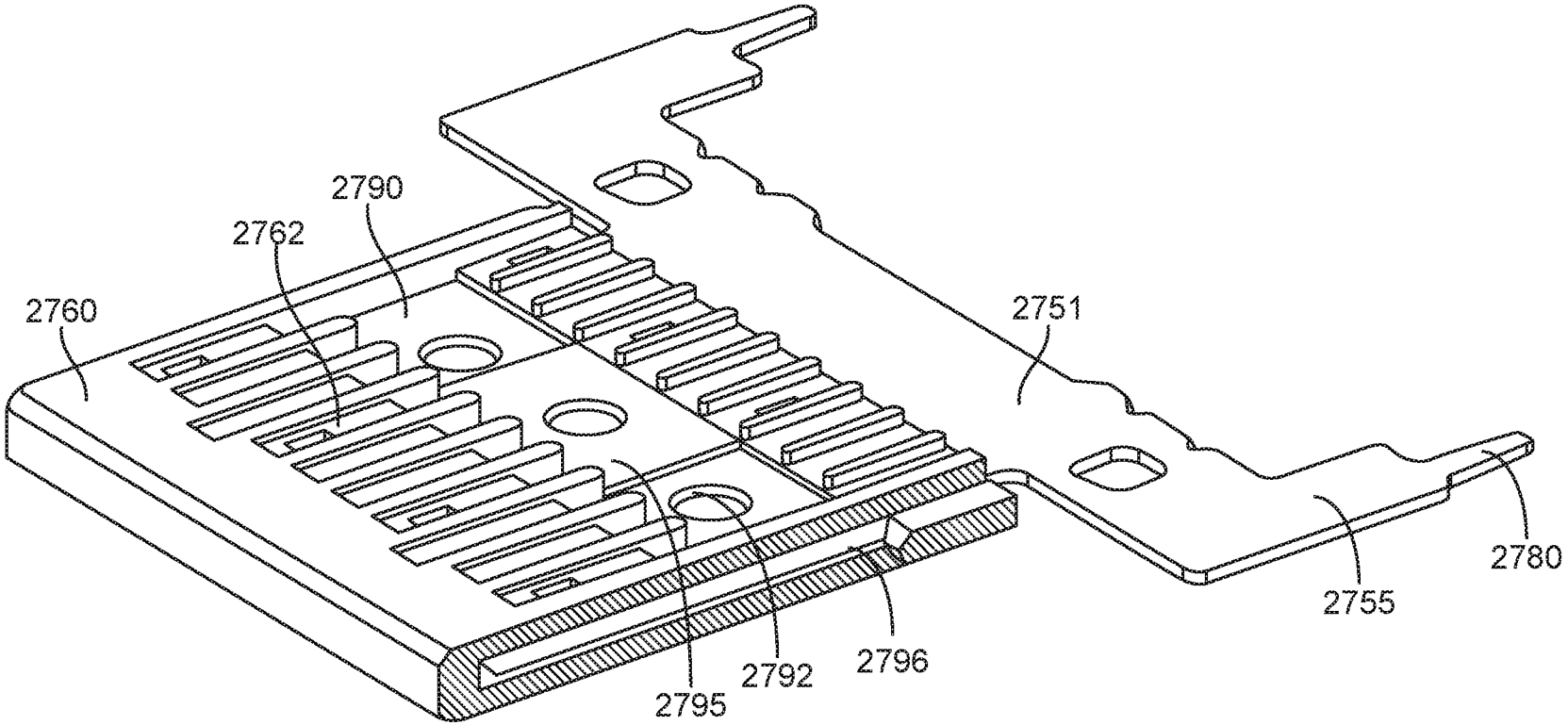
FIG. 27 illustrates a portion of a connector receptacle according to an embodiment of the present invention.

FIG. 27 illustrates a portion of a connector receptacle according to an embodiment of the present invention. This figure includes central ground plane 2751 and tongue molding 2760. Central ground plane 2751 may include through-hole contacting portions 2780. Central ground plane 2751 may be spot or laser welded to frame support 2758 (shown in FIG. 26) at point 2755.

Tongue molding 2760 may include grooves 2762 for contacts 2740 (shown in FIG. 26.) Tongue molding 2760 may include open areas 2790 having holes 2792. Tongue molding 2760 may further include area 2795. Either an edge of central ground plane 2751 or tongue molding 2760 may be used to form edge 2796.

Figure 28:
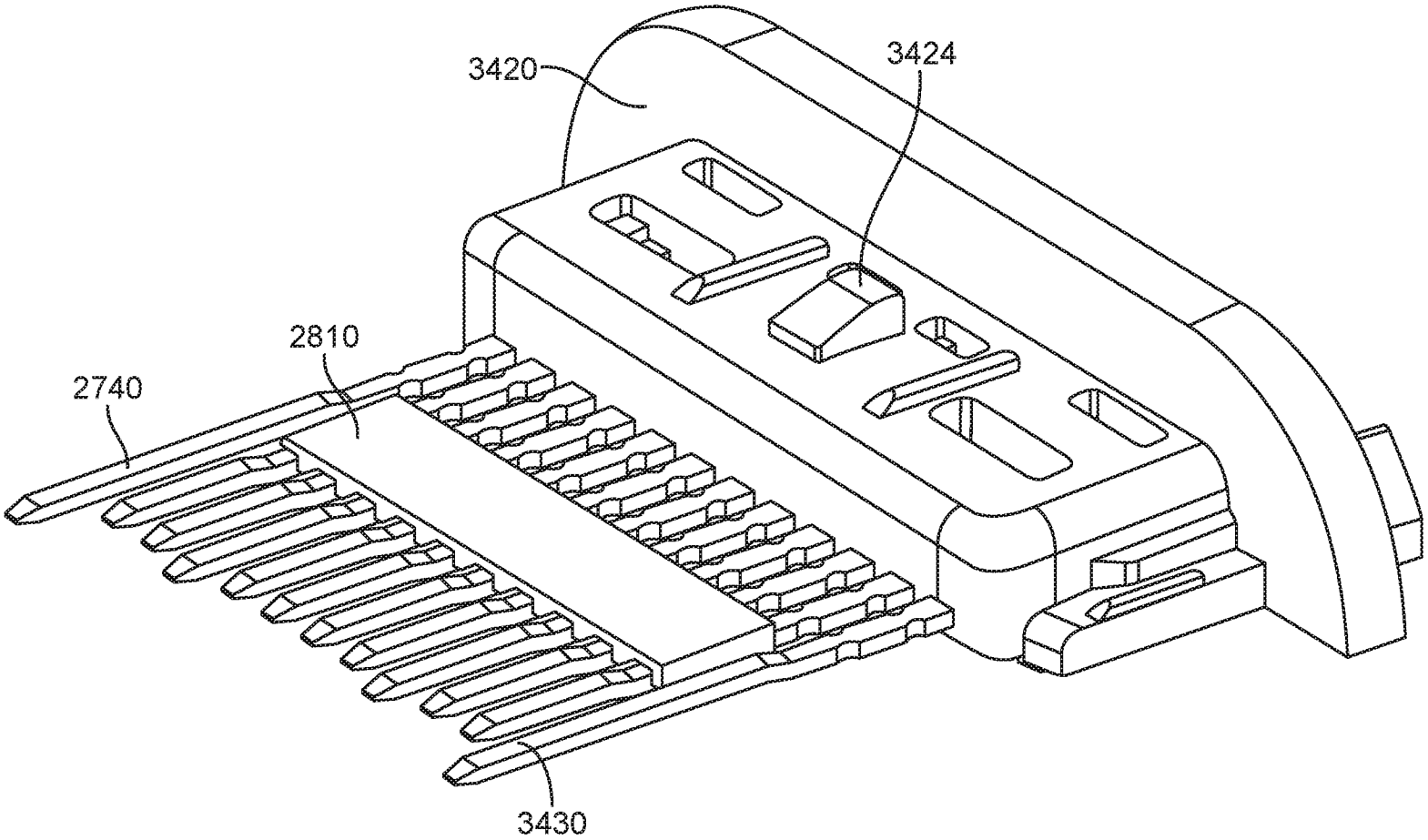
FIG. 28 illustrates another portion of a connector receptacle according to an embodiment of the present invention.

FIG. 28 illustrates a portion of a connector receptacle according to an embodiment of the present invention. A top set 3430 of contacts 2740 may be partially housed in top contact housing 3420. Top contact housing 3420 may include tab 3424 that may be inserted into opening 2759 in frame support 2758 (shown in FIG. 26.) An insulative molding 2810 may be formed around a portion of contacts 2740.

Figure 29:
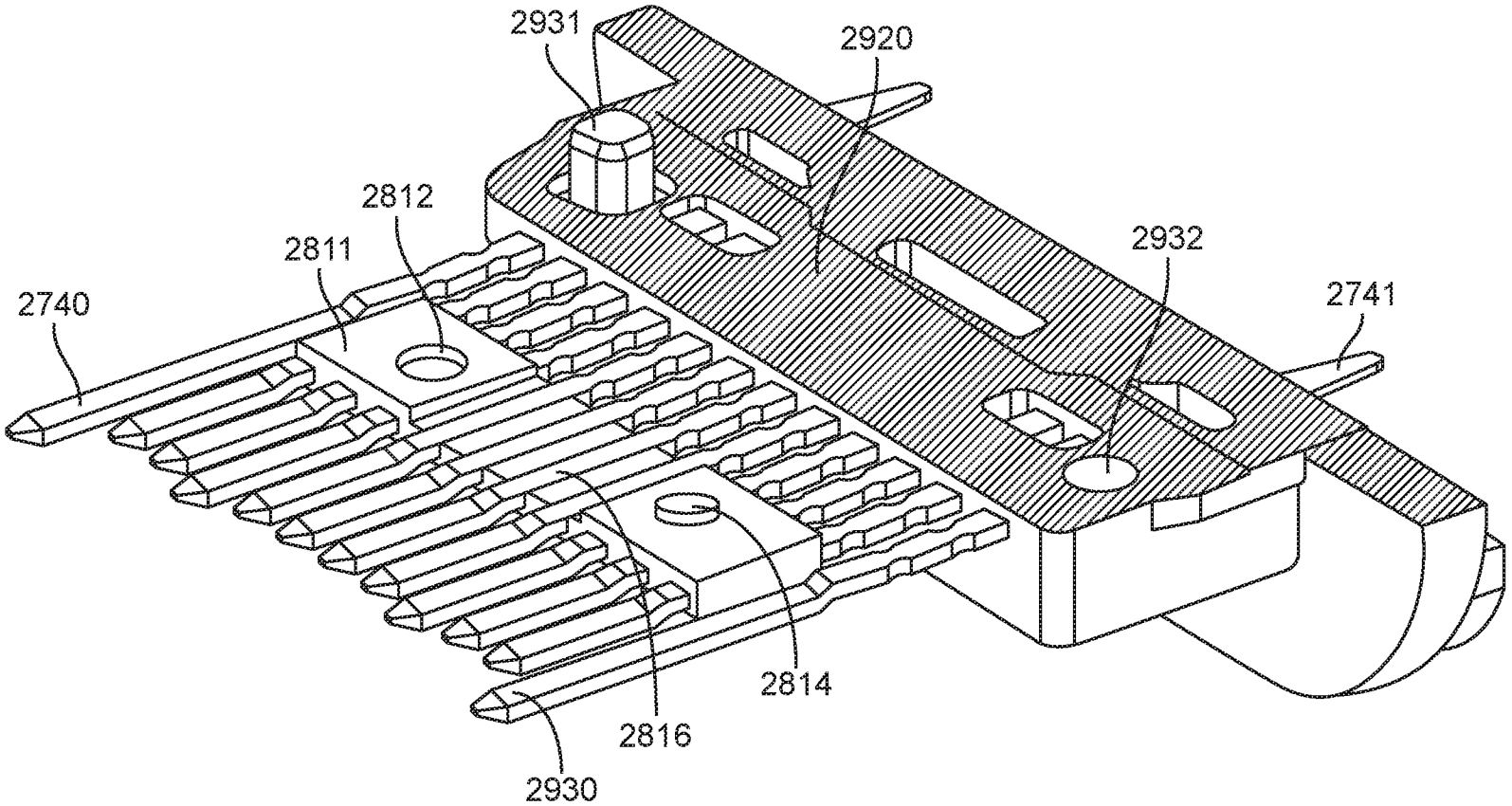
FIG. 29 illustrates another portion of a connector receptacle according to an embodiment of the present invention.

FIG. 29 illustrates another portion of a connector receptacle according to an embodiment of the present invention.

A bottom set 2930 of contacts 2740 may be partially housed in bottom contact housing 2920. Interlocking features 2931 and 2932 may mate up with corresponding features on top contact housing 3420 to secure top contact housing 3420 and bottom contact housing 2920 together after assembly. These interlocking features may pass through holes 2792 (shown in FIG. 27) in central ground plane 2751.

Insulative molding 2811 may be formed over a number of contacts 2740. Insulative molding 2811 may include interlocking features 2812 and 2814, which may mate with interlocking features on insulative molding 2810 to secure molding 2810 and molding 2811 together after assembly. Insulative molding 2810 may include open area 2816 which may align with area 2795 of tongue molding 2760 (shown in FIG. 27.)

Figure 30:
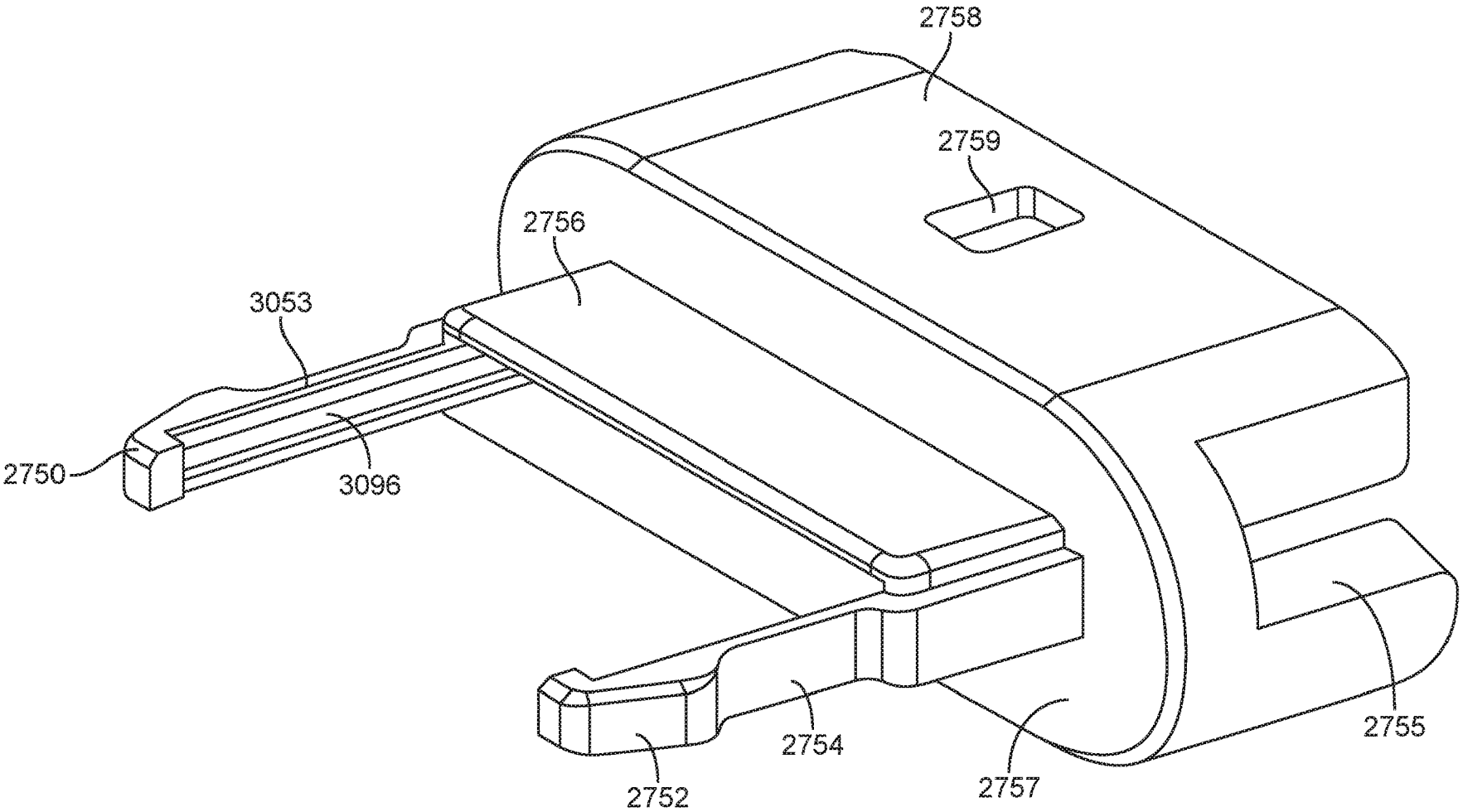
FIG. 30 illustrates a frame for a connector receptacle according to an embodiment of the present invention.

FIG. 30 illustrates a frame for a connector receptacle according to an embodiment of the present invention. Frame 2750 may include frame sides 2752. Frame sides 2752 may include notches 2754. Frame sides 2752 may include slots 3053 for ground contacts in contacts 2740. Frame sides 2752 may include grooves 3096 for accepting edges 2796 of central ground plane 2751 (shown in FIG. 27.) Frame 2750 may further include ground pads 2756 emerging from a face 2757 of frame support 2758. Frame 2750 may include soldering point 2755 and opening 2759, as before.

The connector receptacle of these figures may be assembled by attaching insulative moldings 2810 and 2811 together, one on each side of central ground plane 2751 and tongue molding 2760, as well as by attaching top contact housing 3420 and bottom contact housing 2920 together by interlocking their interlocking features. This assembled portion may then be inserted into frame 2750 such that edges 2796 of central ground plane fit in grooves 3096 of frame 2750. Tabs 2794 may fit in openings 2759 of frame 2750.

While embodiments of the present invention may be useful as USB Type-C connector receptacles, these and other embodiments of the present invention may be used as connector receptacles in other types of connector systems.

In various embodiments of the present invention, frames, shields, and other conductive portions of a connector tongue may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the reflow caps and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards used may be formed of FR-4 or other material.

Embodiments of the present invention may provide connector tongues for connector receptacles and connector inserts that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These connector receptacles and connector inserts may provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector receptacles and connector inserts that may be used to provide a reduced set of functions for one or more of these standards. In various embodiments of the present invention, these interconnect paths provided by these connector receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:

a tongue;

a first plurality of contacts, each having a contacting portion on a top of the tongue;

a second plurality of contacts, each having a contacting portion on a bottom of the tongue, each contacting portion for connecting to a corresponding contact in a corresponding connector when the connector receptacle is mated with the corresponding connector;

a first plurality of adhesive portions, each between a contacting portion of one of the first plurality of contacts and the tongue; and a second plurality of adhesive portions, each between a contacting portion of one of the second plurality of contacts and the tongue.

2. The connector receptacle of claim 1 wherein each of the first plurality of contacts and each of the second plurality of contacts further comprises a tail portion and a middle transition portion, the middle transition portion between the contacting portion and the tail portion.

3. The connector receptacle of claim 2 further comprising:

a first housing around the middle transition portion of each of the first plurality of contacts; and a second housing around the middle transition portion of each of the second plurality of contacts.

4. The connector receptacle of claim 3 wherein the tongue comprises:

a central ground plane;

a first ground contact portion comprising a surface for a first ground contact;

a second ground contact portion comprising a surface for a second ground contact; and a third housing around the central ground plane, a portion of the third housing forming the tongue, wherein the first ground contact is positioned on the top of the tongue and the second ground contact is positioned on the bottom of the tongue.

5. The connector receptacle of claim 4 wherein the contacting portion of each of the first plurality of contacts and each of the second plurality of contacts are located in slots in the tongue.

6. The connector receptacle of claim 5 further comprising:

a top shield over a top, back, and sides of the connector receptacle; and a bottom shield over a lower portion of a front of the connector receptacle, wherein a raised portion on the top shield fits in an opening in the bottom shield.

7. The connector receptacle of claim 6 wherein a tab on the second housing fits in a notch on the first housing.

8. A connector receptacle comprising:

a tongue;

a first plurality of contacts, each having a contacting portion on a top of the tongue and a leading edge near a front of the connector receptacle;

a second plurality of contacts, each having a contacting portion on a bottom of the tongue and a leading edge near a front of the connector receptacle, the contacting portions for connecting to corresponding contacts in a corresponding connector when the connector receptacle is mated with the corresponding connector;

a first housing supporting the first plurality of contacts; and an overmold over at least a portion of the first housing and covering the leading edges of the first plurality of contacts and the leading edges of the second plurality of contacts.

9. The connector receptacle of claim 8 wherein the leading edges of the first plurality of contacts and the leading edges of the second plurality of contacts are angled towards a center of the tongue.

10. The connector receptacle of claim 9 wherein each of the first plurality of contacts and each of the second plurality of contacts further comprises a tail portion and a middle transition portion, the middle transition portion between the contacting portion and the tail portion.

11. The connector receptacle of claim 10 further comprising:

a second housing around the middle transition portion of each of the first plurality of contacts; and a third housing around the middle transition portion of each of the second plurality of contacts.

12. The connector receptacle of claim 11 wherein the tongue comprises:

a central ground plane;

a first ground contact portion comprising a surface for a first ground contact; and a second ground contact portion comprising a surface for a second ground contact.

13. The connector receptacle of claim 12 wherein a tab on the second housing fits in a notch on the third housing.

14. A connector receptacle comprising:

a frame comprising side portions, a cross-beam near a leading edge of the connector receptacle, a top ground contact, and a bottom ground contact, the frame formed as a single piece;

a tongue;

a first plurality of contacts, each having a contacting portion on a top of the tongue and between the cross-beam, the side portions, and the top ground contact;

a second plurality of contacts, each having a contacting portion on a bottom of the tongue and between the cross-beam, the side portions, and the bottom ground contact, each contacting portion for connecting to corresponding contacts in a corresponding connector when the connector receptacle is mated with the corresponding connector;

a first molding over the first plurality of contacts and between the top ground contact and the tongue, the first molding extending over a portion the contacting portion of each of the first plurality of contacts near the top ground contact such that a top surface of the first molding extends beyond the top ground contact towards the cross-beam; and a second molding over the second plurality of contacts and between the bottom ground contact and the tongue and extending over a portion the contacting portions of the second plurality of contacts near the bottom ground contact.

15. The connector receptacle of claim 14 wherein each of the first plurality of contacts and each of the second plurality of contacts further comprises a tail portion and a middle transition portion, the middle transition portion between the contacting portion and the tail portion.

16. The connector receptacle of claim 15 further comprising:

a first housing around the middle transition portion of each of the first plurality of contacts; and a second housing around the middle transition portion of each of the second plurality of contacts.

17. The connector receptacle of claim 16 wherein a tab on the first housing fits in a notch on the second housing.

18. The connector receptacle of claim 17 further comprising:

a top shield over a top, back, and sides of the connector receptacle; and a bottom shield over a lower portion of a front of the connector receptacle, wherein a raised portion on the top shield fits in an opening in the bottom shield.

* * * * *